US005746842A

United States Patent [19]

Eguchi et al.

[11] Patent Number: 5,746,842

[45] Date of Patent: May 5, 1998

[54] STEEL GEAR

[75] Inventors: Toyoaki Eguchi, Izumi-ku; Hiroshi Majima, Aoba-ku, both of Japan

[73] Assignee: Toa Steel Co., Ltd., Tokyo, Japan

[21] Appl. No.: 536,997

[22] Filed: Sep. 29, 1995

[51] Int. Cl.[6] ..... C22C 38/22; C22C 38/44

[52] U.S. Cl. ..... 148/319; 420/105; 420/108; 420/109

[58] Field of Search ..... 420/105, 108, 420/109, 110, 111; 148/319

[56] References Cited

U.S. PATENT DOCUMENTS

| | | | |
|---|---|---|---|
| 1,544,422 | 6/1925 | Becket . | |
| 3,713,905 | 1/1973 | Philip et al. | 148/319 |
| 4,175,987 | 11/1979 | Rice . | |
| 4,773,947 | 9/1988 | Shibata et al. | 148/319 |

FOREIGN PATENT DOCUMENTS

| | | |
|---|---|---|
| 2 174 073 | 10/1973 | France . |
| 59-123743 | 7/1984 | Japan . |
| 63-65053 | 3/1988 | Japan . |
| 2-101154 | 4/1990 | Japan . |
| 3-260048 | 11/1991 | Japan . |
| 4-32537 | 2/1992 | Japan . |
| 4-247848 | 9/1992 | Japan . |
| 5-070925 | 3/1993 | Japan . |
| 5-70924 | 3/1993 | Japan . |
| 1 417 330 | 12/1975 | United Kingdom . |

OTHER PUBLICATIONS

Patent Abstracts of Japan, vol. 17, No. 394 (C–1088) 23 Jul. 1993 of JP–A–05 070 924 (Nippon Steel Corp.), 23 Mar. 1993.

Patent Abstracts of Japan, vol. 12, No. 297 (C–519), 12 Aug. 1988 of JP–A–63 065 053 (Kobe Steel Ltd.), 23 Mar. 1988.

Patent Abstracts of Japan, vol. 16, No. 198 (C 0939), 13 May 1992 of JP–A–04 032 537 (Nissan Motor Co., Ltd.), 4 Feb. 1992.

Patent Abstracts of Japan, vol. 14, No. 304 (C–734), 29 Jun. 1990 of JP–A–02 101 154 (Kawasaki Heavy Ind. Ltd.), 12 Apr. 1990.

*Primary Examiner*—Deborah Yee

*Attorney, Agent, or Firm*—Frishauf, Holtz, Goodman, Langer & Chick, P.C.

[57] ABSTRACT

Steel for forming a gear by carburizing and quenching consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, and the balance being Fe and inevitable impurities. The steel has an $Ac_3$ point parameter ($Ac_3$) and an ideal critical diameter ($D_I$), the $Ac_3$ point parameter being in a range of 850° to 960 ° C., the ideal critical diameter ($D_I$) being in a range of 30 to 250 mm, and the $Ac_3$ point parameter ($Ac_3$) and the ideal critical diameter ($D_I$) being defined by the following equations.

$$Ac_3=920-203\sqrt{C}+44.7\ Si+31.5\times Mo-30\times Mn-11\times Cr$$

$$D_I=7.95\sqrt{C}(1+0.70\times Si)\ (1+3.3\times Mn)(1+2.16\times Cr)\ (1+3.0\times Mo)$$

The steel has a non-carburized portion after carburizing and quenching, an internal structure of the non-carburized portion comprising a dual phase of martensite and ferrite, said ferrite having an area percentage of 10 to 70% in the dual phase.

77 Claims, 5 Drawing Sheets

STEEL GEAR

BACKGROUND OF THE INVENTION

1. Field of the Invention

The present invention relates to a steel for forming a gear by carburizing and quenching.

2. Description of the Related Arts

Automobiles have recently significantly improved calmness during driving. Nevertheless, noise generation during driving remains owing mainly to gear noise. The gear noise comes from insufficient mating of gears. The cause of that type of insufficient mating of gears is a deformation occurred during the carburizing and quenching or carbon-nitriding and quenching applied to the steel shaped to form the gear for hardening the surface thereof. Hereinafter the carburizing and quenching or the carbon-nitriding and quenching are referred to simply as carburizing and quenching.

During the carburizing and quenching of steel for forming a gear, a transformation stress occurs owing to the formation of martensite. The transformation stress is a stress caused by a volumetric expansion which occurs during the transformation from austenite structure to martensite structure. The generated transformation stress inevitably induces distortion of steel, which hinders a high precision shaping of gear. In particular, gears for transmission of automobile are small in size and thin in thickness, though they are under a severe restriction to noise generation. In addition, since the internal structure of the steel is occupied by martensite which contains bainite in a part thereof. The internal structure likely induces distortion during the carburizing and quenching. Accordingly, the shape and structure are the largest causes of gear noise.

To improve the precision of gear shaping, a carburized and quenched steel for forming gear is subjected to gear shape correction treatment by machining which removes a part of the carburized layer to reduce the amount of quenching deformation. Such tooth shape correction by machining, however, increases the number of production steps and significantly decreases the productivity. In addition, the machining is a very expensive operation so that the production cost is remarkably raised.

Furthermore, surface hardness and residual stress become uneven on the surface. This also raises a quality problem.

Therefore, a steel for forming a gear is often used without applying gear shape correction to the steel after the carburizing and quenching. As a result, reduction of quenching distortion is required to improve the precision of the carburized and quenched gear. The degree of quenching distortion largely depends on the hardenability of the base material. In addition, since the carburizing and quenching is normally conducted at high temperatures around 920° C., the austenite grains become coarse ones during the carburization. The coarse grains are one of the cause of distortion.

There are many studies for decreasing the quenching distortion of steel for forming a gear. For example, a method was proposed to suppress the hardenability by controlling the chemical composition within a specified narrow range to bring the hardenability to the lower limit of Jominy band. JP-A-4-247848 and JP-A-59-123743 (the term JP-A- referred to herein dignifies "unexamined Japanese patent publication") disclose a method for finely adjusting the grains of Al, Ti, and Nb within the steel. The technology disclosed in JP-A-4-247848 and JP-A-59-123743, however, has a limitation in suppressing the generation of distortion accompanied with martensite transformation, and the distortion cannot be controlled to be sufficiently small level.

JP-A-5-70925 discloses a method to make the structure of an inside of the gear a fine ferrite-pearlite structure while maintaining the structure of the surface of the gear tooth austenite structure. According to the disclosed method, a gear made of a steel containing a specified content range of Si, Mn, Cr, Mo, and V is subjected to carbon-nitriding. After the carbon-nitriding, the gear is cooled to below a temperature level of $Ar_1$ transformation point on the surface of the gear teeth, or the carbon-nitrided portion. Then, the gear is held at a temperature ranging from $Ar_3$ transformation point on the surface of gear tooth to $Ar_1$ transformation point on the inside of the gear (non-carburized portion), followed by quenching and tempering. The technology disclosed in JP-A-5-70925 deals with the ferrite-pearlite structure at the inside of the gear (non-carburized portion), so it is difficult to assure sufficient toughness. In addition, the technology requires complex heat treatment, which degrades the productivity and increases production cost.

For example, JP-A-3-260048 discusses a means for decreasing the distortion resulted from heat treatment. The means includes low temperature nitriding such as tufftriding, gas nitriding, and gas soft-nitriding. The technology disclosed in JP-A-3-260048 provides a hard surface layer having favorable abrasion resistance, and provides small distortion of the work owing to a low temperature processing in a range of from 500° to 700° C. Nevertheless, the technology has disadvantages that the hard surface layer has a shallow depth and that a long processing period as long as 50 to 100 hours is required to obtain a sufficient thickness of hard layer. These disadvantages degrade productivity and increase the production cost.

SUMMARY OF THE INVENTION

The present invention provides a steel for forming a gear, which steel generates extremely small distortion during carburizing and quenching, and which provides a high precision gear that generates no noise, and which allows for easy heat treatment and economical production of the gear.

To achieve the object described above, the present invention provides a steel for forming a gear by carburizing and quenching consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, and the balance being Fe and inevitable impurities;

said steel having an $Ac_3$ point parameter ($Ac_3$) and an ideal critical diameter ($D_I$), said $Ac_3$ point parameter being in a range of 850° to 960° C., said ideal critical diameter ($D_I$) being in a range of 30 to 250 mm, and the $Ac_3$ point parameter ($Ac_3$) and the ideal critical diameter ($D_I$) being defined by the following equations;

$$Ac_3=920-203\sqrt{C}+44.7\times Si+31.5\times Mo-30\times Mn-11\times Cr$$

$$D_I=7.95\sqrt{C}(1+0.70\times Si)\ (1+3.3\times Mn)\ (1+2.16\times Cr)\ (1+3.0\times Mo)$$

said steel having a non-carburized portion after carburizing and quenching, an internal structure of the non-carburized portion comprising a dual phase of martensite and ferrite, said ferrite having an area percentage of 10 to 70% in the dual phase; and said steel having a distortion of a Navy C specimen after the carburizing and quenching, said distortion being 1% or less.

The steel may further contain at least one element selected from the group of 0.01 to 2 wt. % Ni, 0.01 to 0.7 wt. % W, 0.01 to 1 wt. % V, 0.005 to 2 wt. % Al, 0.005 to 1 wt. % Ti, 0.005 to 0.5 wt. % Nb, and 0.005 to 0.5 wt. % Zr. In this case, the steel has an $Ac_3$ point parameter ($Ac_3$) and an ideal critical diameter ($D_I$), both of which are defined by the following equations. The $Ac_3$ point parameter ($Ac_3$) is in a range of from 850° to 960° C., and the ideal critical diameter ($D_I$) is in a range of from 30 to 250 mm.

$$Ac_3=920-203\sqrt{C}+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)(1+3.3\times Mn)(1+2.16\times Cr)(1+3.0\times Mo)(1+0.36\times Ni)(1+5.0\times V)$$

Furthermore, the present invention provides a steel for forming a gear by carburizing and quenching consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, 0.01 to 2 wt. % Ni, and the balance being Fe and inevitable impurities;

said steel having an $Ac_3$ point parameter ($Ac_3$) and an ideal critical diameter ($D_I$), said $Ac_3$ point parameter being in a range of 850° to 960° C., said ideal critical diameter ($D_I$) being in a range of 30 to 250 mm, and the $Ac_3$ point parameter ($Ac_3$) and the ideal critical diameter ($D_I$) being defined by the following equations;

$$Ac_3=920-203\sqrt{C}+44.7\times Si+31.5\times Mo-30\times Mn-11\times Cr-15.2\times Ni$$

$$D_I=7.95\sqrt{C}(1+0.70\times Si)(1+3.3\times Mn)(1+2.16\times Cr)(1+3.0\times Mo)(1+0.36\times Ni)$$

said steel having a non-carburized portion after carburizing and quenching, an internal structure of the non-carburized portion comprising a dual phase of martensite and ferrite, said ferrite having an area percentage of 10 to 70% in the dual phase; and said steel having a distortion of a Navy C specimen after the carburizing and quenching, said distortion being 1% or less.

The steel may further contain at least one element selected from the group consisting of 0.01 to 0.7 wt. % W, 0.01 to 1 wt. % V, 0.005 to 2 wt. % Al, 0.005 to 1 wt. % Ti, 0.005 to 0.5 wt. % Nb, and 0.005 to 0.5 wt. % Zr. In this case, the steel has an $Ac_3$ point parameter ($Ac_3$) and an ideal critical diameter ($D_I$), both of which are defined by the following equations. The $Ac_3$ point parameter ($Ac_3$) is in a range of from 850° to 960° C., and the ideal critical diameter ($D_I$) is in a range of from 30 to 250 mm.

$$Ac_3=920-203+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)(1+3.3\times Mn)(1+2.16\times Cr)(1+3.0\times Mo)(1+0.36\times Ni)(1+5.0\times V)$$

In addition, the present invention provides a steel for forming a gear by carburizing and quenching consisting essentially of: 0.1 to 0.35 wt. % C, 0.01 to 2.5 wt. % Si, 0.01 to 2.5 wt. % Al, 0.5 to 2.6 wt. % Si+Al, 0.2 to 2.5 wt. % Mn, 0.01 to 2.5 wt. % Cr, and the balance being Fe and inevitable impurities;

said steel having an $Ac_3$ point parameter ($Ac_3$) and an ideal critical diameter ($D_I$), said $Ac_3$ point parameter being in a range of 850° to 960° C., said ideal critical diameter ($D_I$) being in a range of 30 to 250 mm, and the $Ac_3$ point parameter ($Ac_3$) and the ideal critical diameter ($D_I$) being defined by the following equations;

$$Ac_3=920-203\sqrt{C}+44.7\times Si-30\times Mn-11\times Cr+40\times Al$$

$$D_I=7.95\sqrt{C}(1+0.70\times Si)(1+3.3\times Mn)(1+2.16\times Cr)$$

said steel having a non-carburized portion after carburizing and quenching, an internal structure of the non-carburized portion comprising a dual phase of martensite and ferrite, said ferrite having an area percentage of 10 to 70% in the dual phase; and said steel having a distortion of a Navy C specimen after the carburizing and quenching, said distortion being 1% or less.

The steel may further contain at least one element selected from the group consisting of 0.01 to 0.7 wt. % Mo, 0.01 to 2 wt. % Ni, 0.01 to 0.7 wt. % W, 0.01 to 1 wt. % V, 0.005 to 1 wt. % Ti, 0.005 to 0.5 wt. % Nb, and 0.005 to 0.5 wt. % Zr. In this case, the steel has an $Ac_3$ point parameter ($Ac_3$) and an ideal critical diameter ($D_I$), both of which are defined by the following equations and wherein the $Ac_3$ point parameter ($Ac_3$) is in a range of from 850° to 960° C., and the ideal critical diameter ($D_I$) is in a range of from 30 to 250 mm.

$$Ac_3=920-203\sqrt{C}+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)(1+3.3\times Mn)(1+2.16\times Cr)(1+3.0\times Mo)(1+0.36\times Ni)(1+5.0\times V)$$

DESCRIPTION OF THE EMBODIMENT

EMBODIMENT-1

Figure 1:
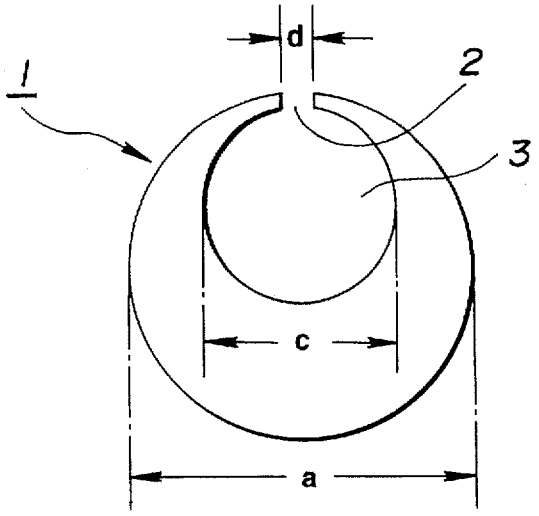
FIG. 1 is a front view of an example specimen for determining the degree of carburizing and quenching distortion.

The main variable which affects the degree of quenching distortion of a steel for forming a gear is the degree of distortion caused by volume expansion which occurs during the transformation from austenite structure to martensite structure. The inventors found that the quenching distortion drastically decreases by the presence of ferrite at a rate of 10 to 70% in the austenite structure during the heating stage before the quenching and by the formation of a ferrite-martensite dual phase structure after the carburizing and quenching.

To introduce ferrite into the austenite structure under a normal carburizing condition, it is necessary to raise the $Ac_3$ transformation temperature. In this respect, the inventors studied on the effect of steel components such as Si, Mn, Cr, Mo, Al, and V on the $Ac_3$ transformation temperature, and found that the quenching distortion drastically decreases by adjusting the content of these components. The adjustment easily provides the ferrite-martensite dual phase structure under a normal carburizing condition, strengthens the inside of gear (non-carburizing portion) owing to the ferrite-strengthening elements without decreasing the fatigue strength.

The steel for forming a gear of this invention consists essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, and balance being Fe and inevitable impurities. The steel has an $Ac_3$ point parameter ($Ac_3$) and an ideal critical diameter ($D_I$), both of which are defined by the following equations. The $Ac_3$ point parameter ($Ac_3$) is in a range of from 850° to 960° C., and the ideal critical diameter ($D_I$) is in a range of from 30 to 250 mm. The steel has a non-carburized portion after carburizing, and the internal structure of the non-carburized portion consists of a dual phase of martensite containing ferrite at a range of from 10 to 70%. The deformation of a Navy C specimen after the carburization is 1% or less.

$$Ac_3=920-203+44.7\times Si+31.5\times Mo-30\times Mn-11\times Cr$$

$$D_I=7.95\sqrt{C}(1+0.70\times Si)\ (1+3.3\times Mn)\ (1+2.16\times Cr)\ (1+3.0\times Mo)$$

The steel may further contain at least one element selected from the group consisting of 0.01 to 2 wt. % Ni, 0.01 to 0.7 wt. % W, 0.01 to 1 wt. % V, 0.005 to 2 wt. % Al, 0.005 to 1 wt. % Ti, 0.005 to 0.5 wt. % Nb, and 0.005 to 0.5 wt. % Zr. In this case, the steel has an $Ac_3$ point parameter $Ac_3$ and an ideal critical diameter ($D_I$), both of which are defined by the following equations. The $Ac_3$ point parameter ($Ac_3$) is in a range of from 850° to 960° C., and the ideal critical diameter ($D_I$) is in a range of from 30 to 250 mm.

$$Ac_3=920-203\sqrt{C}+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)\ (1+3.3\times Mn)\ (1+2.16\times Cr)\ (1+3.0\times Mo)\ (1+0.36\times Ni)\ (1+5.0\times V)$$

According to the invention, an increase of the content of Si, Mo, Al, V, and Ti which are the elements of increasing the $Ac_3$ transformation temperature and improving hardenability easily forms a ferrite-martensite dual phase structure during the carburizing and quenching stage. The formed ferrite absorbs the expansion distortion of martensite to significantly reduce the degree of quenching distortion, and further secures the core hardness during the quenching stage, so a fatigue strength similar to the conventional steel is obtained.

Gears for automobiles are often subjected to shot peening to improve the fatigue strength. Since the steel of this invention reduces the surface grain boundary oxide layer and prevents the generation of an insufficiently quenched structure, the shot peening does not deteriorate the surface roughness, and the presence of Si, Mo, W, and V increases the tempering softening resistance, which then results in an improved fatigue strength of a tooth face.

The reasons to limit the chemical composition of the steel for forming a gear of this invention to a range described above is detailed in the following.

(1) Carbon (C)

Carbon is a basic element necessary to assure the core strength during the carburizing and quenching. To perform the function, the necessary content of carbon is 0.10 wt. % or more. The content less than 0.10 wt. % is not favorable because the heat treatment period to obtain an effective depth of carburized layer is prolonged. The content of carbon above 0.35 wt. % induces deterioration of toughness and of machinability. Accordingly, the content of carbon should be limited to a range of from 0.10 to 0.35 wt. %. The carbon range of 0.15 to 0.25 wt. % is more preferable.

(2) Silicon (Si)

Silicon plays an important role in the invention. That is, silicon is an element for forming ferrite, and a relatively inexpensive and effective element for increasing the $Ac_3$ transformation point. The content less than 0.5 wt. %, however, lowers the silicon content in the surface layer to bond to oxygen that exists in a small amount in the carburization gas during the carburizing stage, so the slight amount of oxygen penetrates deep into the steel body to significantly deepen the grain boundary oxide layer, and finally results in the reduction of fatigue strength. On the other hand, silicon content above 2.5 wt. % makes the presence of ferrite excessive, and degrades both strength and toughness. Furthermore, the excess presence of silicon increases the inclusion of $SiO_2$ group, and deteriorates the fatigue strength. Consequently, the silicon content should be limited to a range of from 0.5 to 2.5 wt. %. The silicon range of 0.8 to 2.2 wt. % is more preferable.

(3) Manganese (Mn)

Manganese is an effective element to improve the hardenability and to secure the core strength. To perform the functions, the necessary manganese content is 0.20 wt. % or more. Manganese, however, has a function to considerably lower the $Ac_3$ transformation point. So the manganese content above 2.50 wt. % interferes the formation of dual phase structure, and results in excessively high hardness, which leads to the deterioration of machinability. Therefore, the manganese content should be limited to a range of from 0.20 to 2.50 wt. %. The manganese range of 0.5 to 2.0 wt. % is more preferable.

(4) Chromium (Cr)

Chromium is an effective element to improve the hardenability similar to manganese. The necessary content of chromium to perform the function is 0.01 wt. % or more. Chromium, however, has a function to considerably lower the $Ac_3$ transformation point as in the case of manganese. So the chromium content above 2.50 wt. % interferes the formation of dual phase structure, and results in excessively high hardness, which leads to the deterioration of machinability. Therefore, the chromium content should be limited to a range of from 0.01 to 2.50 wt. %. The chromium range of 0.2 to 2 wt. % is more desirable.

(5) Molybdenum (Mo)

Molybdenum is an effective element for increasing $Ac_3$ transformation point and improving hardenability, toughness, and fatigue strength. The necessary content of molybdenum to perform the function is at 0.01 wt. % or more. Molybdenum is, however, extremely expensive, and the addition of Molybdenum above 0.70 wt. % saturates its effect and results in an economical disadvantage. So the molybdenum content should be limited to a range of from 0.01 to 0.70 wt. %. The molybdenum range of 0.1 to 0.5 wt. % is more desirable.

(6) Nickel (Ni)

Nickel is an effective element to improve hardenability and toughness. The necessary content of nickel to perform the function is 0.01 wt. % or more. The nickel content above 2.0 wt. %, however, makes the hardness too high and deteriorates the machinability. In addition, nickel is so expensive element so that excessive addition leads to an economical disadvantage. Consequently, the nickel content should be limited to a range of from 0.01 to 2.0 wt. %. The nickel range of 0.1 to 1.5 wt. % is more desirable.

(7) Tungsten (W)

Tungsten is an effective element to increase $Ac_3$ transformation point similar to molybdenum, and improve toughness and fatigue strength. The necessary content of tungsten to perform the function is 0.01 wt. % or more. Tungsten is, however, also expensive, and the addition of above 0.70 wt. % results in an economical disadvantage compared with the enhanced effect. Accordingly, the tungsten content should be limited to a range of from 0.01 to 0.70 wt. %. In the case that tungsten and molybdenum are added simultaneously, the total content of them is preferably at 0.70 wt. % or less. The total content of above 0.70 wt. % is unfavorable because of the increase of carburizing and quenching distortion.

(8) Vanadium (V)

Vanadium has a strong effect to increase $Ac_3$ transformation point, and is effective for improving hardenability and fatigue strength. In addition, vanadium has a function to form carbon-nitride, to make grains fine, and to suppress the quenching deformation. The necessary content of vanadium to perform the functions is 0.01 wt. % or more. The vanadium content above 1.0 wt. %, however, saturates the effect and results in an economical disadvantage, and furthermore, results in excess carbon-nitride presence to degrade toughness. Therefore, the vanadium content should be limited to a range of from 0.01 to 1.0 wt. %.

(9) Aluminum (Al)

Aluminum is an effective element to form AlN by bonding to nitrogen, to form fine grains to reduce the quenching distortion, and to improve toughness and fatigue strength. The necessary content of aluminum to perform the functions is 0.005 wt. % or more. Similar to silicon, aluminum is a ferrite-forming element, and allows to significantly increase $Ac_3$ transformation point under an economical condition. If, however, the aluminum content exceeds 2.0 wt. %, then the alumina group inclusion increases to degrade toughness and fatigue strength. Consequently, the aluminum content should be limited to a range of from 0.005 to 2.0 wt. %. When aluminum is added along with silicon, the total content of them should be limited at 2.6 wt. % or less to secure the cleanliness and toughness of the steel.

(10) Titanium (Ti)

Titanium is also an element to form ferrite, and has a strong function for increasing $Ac_3$ transformation point. Titanium is an effective element to form fine austenite grains, and to contribute to the increase of fatigue strength by increasing the yield strength at the carburized portion and the inside of steel. The necessary content of titanium to perform the functions is 0.005 wt. % or more. If, however, the titanium content exceeds 1.0 wt. %, then the effect saturates and the economical disadvantage occurs, and furthermore, excess amount of carbon-nitride deteriorates toughness. Therefore, the titanium content should be limited to a range of from 0.005 to 1.0 wt. %.

(11) Niobium (Nb)

Niobium is also an effective element to form fine austenite grains. The necessary content of niobium to perform the function is 0.005 wt. % or more. If, however, the niobium content exceeds 0.50 wt. %, then the effect saturates and the economical disadvantage occurs, and furthermore, excess amount of carbon-nitride deteriorates toughness. Therefore, the niobium content should be limited to a range of from 0.005 to 0.50 wt. %.

(12) Zirconium (Zr)

Zirconium is also an effective element to form fine austenite grains similar to niobium. The necessary content of zirconium to perform the function is 0.005 wt. % or more. If, however, the zirconium content exceeds 0.50 wt. %, then the effect saturates and the economical disadvantage occurs, and furthermore, excess amount of carbon-nitride deteriorates toughness. Therefore, the zirconium content should be limited to a range of from 0.005 to 0.50 wt. %.

Other than the elements described above, the steel of this invention may include P, S, Cu, N, and O as impurities. Among them, N may be added to an amount of up to 0.20 wt. % for forming fine grains. Furthermore, to improve machinability, a free-cutting element such as S, Pb, Ca, and Se may be added.

(13) $Ac_3$ point parameter

Figure 3:
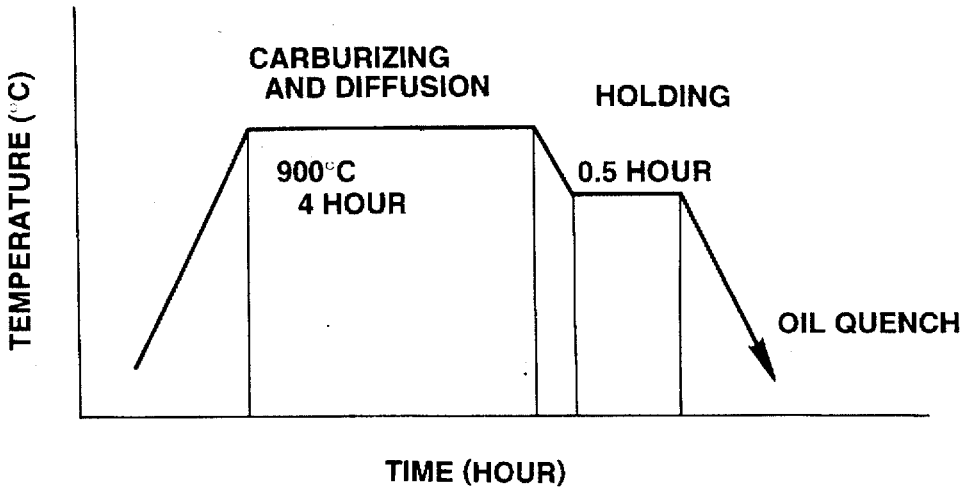
FIG. 3 shows an example of a heat treatment pattern for carburizing and quenching.

FIG. 3 shows an example of a heat treatment pattern during the carburizing stage. The carburizing is conducted at 900° C. to diffuse carbon into the steel structure. The steel is then held at 850° C., which is lower than the temperature of the carburizing, to decrease distortion. Finally, the steel is quenched in an oil or other medium. Accordingly, if the $Ac_3$ point parameter calculated from equation (1) is below 850° C., then the steel can not secure ferrite within the austenite structure even when the steel is held at 850° C. after the carburizing. On the other hand, if the $Ac_3$ point parameter. exceeds 960° C., the ferrite becomes excessive, and the core strength becomes insufficient. Consequently, the $Ac_3$ parameter determined by equation (1) should be limited to a range of from 850° to 960° C. The range of 870° to 930° C. is more preferable.

$$Ac_3=920-203\sqrt{C}+44.7Si+31.5Mo-30Mn-11Cr+40Al-15.2Ni+13.1W+104V+40Ti$$

(14) Ideal critical diameter ($D_I$)

Ideal critical diameter $D_I$ is an index expressing the hardenability of steel. To secure a favorable fatigue strength, the ideal critical diameter $D_I$ calculated by equation (2) as the austenite grain size number 8 should be 30 mm or more. When the $D_I$ value exceeds 250 mm, the effect of ferrite mixed in the austenite structure is lost, and the quenching distortion becomes large. Consequently, the ideal critical diameter $D_I$ calculated by equation (2) as the austenite grain size number 8 should be limited to a range of from 30 to 250 mm. The most preferable range is from 30 to 150 mm.

$$D_I=7.95\sqrt{C}(1+0.70Si)(1+3.3Mn)(1+2.16Cr)(1+3.0Mo)(1+0.36Ni)(1+5.0V) \quad (2)$$

Ideal critical diameter is the critical diameter of the steel which has been subjected to an ideal quenching. In the case of the ideal quenching, the surface temperature of the steel comes instantly to the temperature of the quenching medium.

(15) Amount of ferrite in the internal structure (non-carburized portion)

When the amount of ferrite in the internal structure (non-carburized portion) is less than 10%, the transforming distortion of martensite cannot be fully absorbed, and the quenching distortion cannot be suppressed at a low level. If, however, the amount of ferrite exceeds 70%, then the desired strength and toughness become difficult to attain. Therefore, the amount of ferrite in the internal structure (non-carburized portion) should be limited to a range of from 10 to 70%. The ferrite range of 20 to 60% is more preferable. Further, retained austenite and bainite can be partially included in the martensite.

(16) Carburizing and quenching distortion on Navy C specimen

The determination of distortion after carburizing and quenching is generally carried out by determining the change of opening on a Navy C specimen shown in FIG. 1. When an adopted steel gives a large distortion such as higher than 1% of distortion after the carburizing and quenching on the Navy C specimen, the formed gear shows a large distortion during the carburizing and quenching stage. Such gear needs machining to correct the gear tooth shape.

Therefore, machining of the gear is essential. To provide a carburized gear for use, the distortion after the carburizing and quenching on the Navy C specimen should be 1% or less, and most preferably be 0.5% or less.

EXAMPLE 1

The present invention is described in the following referring to examples and comparative examples.

Ingots allotted by No. 1 through No. 27 were prepared, each of which has the composition listed in Table 1. The ingots No. 1 through No. 15 are the steels of the present invention having the chemical composition, the $Ac_3$ point parameter, and the ideal critical diameter $D_I$ within the limit of the present invention. The ingots No. 16 through No. 23 are the comparative steels which do not meet at least one of the chemical composition range requirements, the $Ac_3$ point parameter, and the ideal critical diameter $D_I$ outside of the limit of the present invention. The ingots No. 24 through No. 27 are the conventional steels.

Comparative steel No. 16 contains larger amount of Mo than the limit of the invention. Comparative steel No. 17 contains Si in amount larger than the limit of the invention, and the $Ac_3$ point parameter is as high as 965° C. Comparative steel No. 18 contains Ti in amount larger than the limit of the invention, and the ideal critical diameter $D_I$ also exceeds the limit of the invention. Comparative steel No. 19 contains smaller amount of C, Si, and Mn than the limit of the invention, and the ideal critical diameter $D_I$ is below the limit of the invention, and Nb content is high. Comparative steel No. 20 contains W and Zr in amount larger than the limit of the invention, and the ideal critical diameter $D_I$ also exceeds the limit of the invention. Comparative steel No. 21 contains C and Cr in amount larger than the limit of the invention, and the $Ac_3$ point parameter is lower than the limit of the invention. Comparative steel No. 22 contains Al, Ni, and V in amount larger than the limit of the invention, and the $Ac_3$ point parameter is as high as 993° C., and also the ideal critical diameter $D_I$ is higher than the limit of the invention. Comparative steel No. 23 contains Mn in amount larger than the limit of the invention, and the $Ac_3$ point parameter is as low as 840° C.

Conventional steels No. 24 through No. 27 are ordinary JIS steels. Conventional steel No. 24 is JIS SMnC420. Conventional steel No. 25 is JIS SCM420. Conventional steel No. 26 is JIS SNCM420. Conventional steel No. 27 is JIS SCM435. All of these conventional steels contain less Si and lower $Ac_3$ point parameter than the limit of the invention.

The ingots of above-described steels of the present invention, the comparative steels, and the conventional steels were hot-rolled to prepare round rods of 20 to 90 mm in diameter. The rods were subjected to normalizing, then they were cut to obtain the quenching deforming test pieces and the fatigue test pieces. These test pieces were treated by carburizing and tempering. Thus treated pieces were tested to determine the degree of carburizing and quenching distortion, the rotational bending fatigue characteristics, and the gear fatigue characteristics. With the rods of 20 mm of diameter, the carburizing and tempering were given, then the tensile test pieces and the impact test pieces were prepared to determine the strength and the toughness.

(1) Degree of carburizing and quenching distortion

Figure 2:
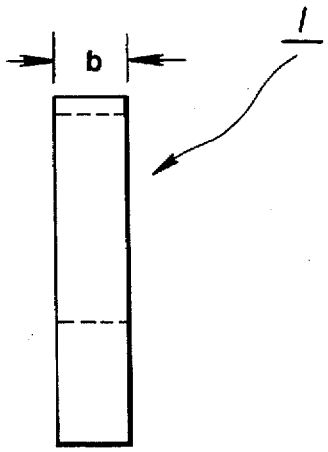
FIG. 2 is a side view of the specimen of FIG. 1.

Disk type Navy C specimens 1 each having an opening 2 and a circular space 3 were prepared from the round rod having a diameter of 65 mm as shown in FIG. 1 and FIG. 2. FIG. 1 is a front view of the specimen and FIG. 2 is a side view thereof. Each of the Navy C specimens has 60 mm of diameter (a), 12 mm of thickness (b), 34.8 mm of circular space diameter (c), and 6 mm of opening (d).

Total ten pieces of Navy C specimen 1 were prepared for each steel. The specimen 1 was carburized under the condition of 900° C. for 3 hours, oil quenched from the temperature of 840° C., and tempered under the condition of 160° C. for 2 hours. The change of opening 2 was then determined, and the observed value was taken as the carburizing distortion. Table 2 lists the depth of a grain boundary oxide layer, the depth of insufficient quenching, the depth of an effective hard layer, the core strength, the impact strength, the ferrite area percentage, and the quenching distortion.

(2) Rotational bending fatigue characteristics

Rotational bending fatigue test pieces each having a notch of 1 mm radius at the parallel portion ( with the stress intensity factor $\alpha$=1.8) were prepared from the round rod having a diameter of 20 mm. The pieces were carburized, and treated by shot peening (0.6 mmA of arc height and 300% of coverage ). The processed pieces were tested for $10^7$ cycles of rotational bending fatigue test using an ONO rotational bending fatigue testing machine to determine the rotational bending fatigue strength. Table 2 shows the observed values of rotational bending fatigue strength.

(3) Gear fatigue characteristics

Test gears having 75 mm of outer diameter, 2.5 of module, 28 gear teeth, and 10 mm of gear tooth width were machined from the round rod of 90 mm diameter. The gears were subjected to carburizing and shot peening under the same conditions as in the case of rotational bending fatigue test. The obtained test pieces underwent the fatigue test using a power circulating gear fatigue testing machine at 3000 rpm. The torque which gave no break after the repetitions of $10^7$ cycles was adopted as the dedendum strength. Table 2 shows the gear fatigue durable torque and the occurrence of chipping.

Table 1 and Table 2 shows the followings. Comparative steel No. 16 contains larger amount of Mo than the limit of the invention, so the quenching distortion exceeded 1%. Comparative steel No. 17 contains larger amount of Si than the limit of the invention, so the sufficient strength cannot be secured, and the rotational bending fatigue strength and the gear fatigue durable torque are low. Comparative steel No. 18 contains larger amount of Ti than the limit of the invention, so the core impact strength is low. In addition, the ideal critical diameter $D_I$ is also larger than the limit of the invention, so the quenching deformation becomes large. Comparative steel No. 19 contains less C, Si, and Mn than the limit of the invention, and the ideal critical diameter $D_I$ also less than the limit of the invention, so the sufficient strength cannot be secured, and the rotational bending fatigue strength and the gear fatigue durable torque are low. In addition, Nb content exceeds the limit of the invention, so the impact strength is low. Comparative steel No. 20 contains larger amount of W than the limit of the invention, and the ideal critical diameter $D_I$ is larger than the limit of the invention, so the quenching distortion exceeds 1%. In addition, the Zr content is also higher than the limit of the invention, so the impact strength is low. Comparative steel No. 21 contains larger amount of C and Cr than the limit of the invention, so the $Ac_3$ point parameter is low, and sufficient amount of ferrite cannot be secured, so the quenching distortion becomes large. Comparative steel No. 22 contains larger amount of Al than the limit of the invention, so the $Ac_3$ point parameter exceeds the limit of the invention, which disables to secure the sufficient fatigue strength. In addition, Ni content is also higher than the limit of the invention, and the ideal critical diameter $D_I$ becomes so large that the quenching distortion becomes large. Comparative steel No. 23 contains larger amount of Mn than the limit of the invention, and the $Ac_3$ point parameter is less than the limit of the invention, so the ferrite area percentage becomes less than 10%, which results in a large quenching distortion.

Conventional steels No. 24 through No. 27 have a ferrite area percentage of 4 to 7%, less than the limit of the invention, so the depth of a grain boundary oxide layer and the depth of an insufficient quenching layer are large, and the quenching distortion is large.

Figure 4:
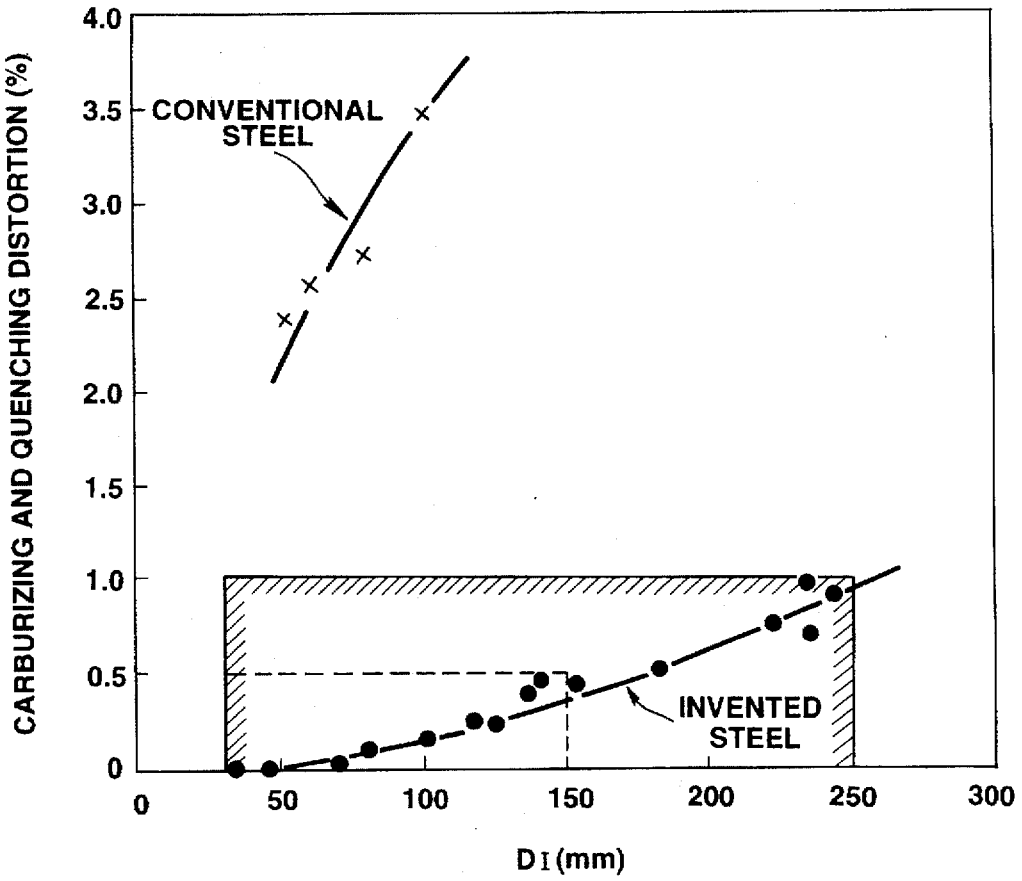
FIG. 4 shows the relation between the ideal critical diameter ($D_I$) and the carburizing and quenching distortion for each of conventional steels and steels of the present invention dealt in EMBODIMENT-1.

To the contrary, compared with the conventional steels, the steels of the invention No. 1 through No. 15 significantly decrease the grain boundary oxide layer, and no insufficient quenched layer is observed, and the carburization characteristics such as the effective hard layer depth of carburization, the core strength, and the impact strength are equivalent to or even higher than those of conventional steels. In addition, the steels of this invention have a ferrite-martensite dual phase structure containing 11 to 69% of ferrite, so the quenching distortion is as small as 0 to 1%, and the dispersion within a lot is small. FIG. 4 shows the relation between the ideal critical diameter $D_I$ and the carburizing distortion for each of the steels of this invention and the conventional steels. The figure shows that the present invention significantly diminishes the heat treatment distortion to a level of from zero distortion to about 40% of the value of conventional steels. Table 1 and Table 2 show that comparative steels No. 17 through No. 22 and conventional steels No. 24 through No. 27 generate pitting on the tooth surface in a low torque region. On the contrary, steels of this invention No. 1 through No. 15 have superior fatigue strength and dedendum strength to conventional steels, and have no insufficient quenched layer, and the increase of Si content increases the tempering softening resistance, which prevented chipping generation and improves the face pressure strength.

As described above, according to the invention, the carburizing distortion is adjustable in a range of from 0 to 1%, compared with the adjusting range of conventional steels from about 2.4 to 3.5%. Thus, the ordinary carburizing produces a steel for forming gears having the high dedendum strength. The steel of the invention is suitable for the gears for automobiles without need of tooth shape correction. Even for gears for construction machines and industrial equipment, whose shape need to be corrected after the carburizing, the steel of the invention minimizes the carburizing distortion, so there is no need of tooth shape correction. Thus, industrial advantages are provided through the reduction of processing cost and the improvement of productivity.

TABLE 1

| | Chemical composition (wt. %) | | | | | | | | | | | | $Ac_3$ Point | $D_I$ Value |
|---|---|---|---|---|---|---|---|---|---|---|---|---|---|---|
| No. | C | Si | Mn | Cr | Mo | Ni | Al | W | V | Ti | Nb | Zr | Parameter | (mm) |
| Steel of the invention | | | | | | | | | | | | | | |
| 1 | 0.20 | 1.38 | 0.61 | 0.52 | 0.02 | — | — | — | — | — | — | — | 867 | 47 |
| 2 | 0.12 | 0.61 | 0.41 | 1.44 | 0.56 | — | — | — | — | — | — | — | 866 | 102 |
| 3 | 0.13 | 2.39 | 0.36 | 0.71 | 0.59 | — | — | — | — | — | — | — | 953 | 118 |
| 4 | 0.28 | 0.81 | 1.03 | 0.14 | 0.68 | — | — | — | — | — | — | — | 869 | 81 |
| 5 | 0.14 | 2.43 | 0.56 | 2.47 | 0.23 | — | — | — | — | — | — | — | 915 | 245 |
| 6 | 0.19 | 2.47 | 2.46 | 0.06 | 0.15 | — | — | — | — | — | — | — | 872 | 141 |
| 7 | 0.22 | 1.45 | 0.68 | 0.45 | 0.58 | 1.95 | 0.87 | — | — | — | — | — | 887 | 224 |
| 8 | 0.11 | 1.90 | 1.86 | 0.26 | 0.35 | 0.86 | — | — | — | — | — | — | 876 | 184 |
| 9 | 0.16 | 0.52 | 0.86 | 0.17 | 0.69 | 0.06 | 1.96 | — | — | — | — | 0.29 | 933 | 71 |
| 10 | 0.12 | 1.65 | 0.37 | 1.75 | 0.39 | — | 0.025 | — | — | — | — | — | 906 | 137 |
| 11 | 0.19 | 2.20 | 0.21 | 1.15 | 0.02 | — | 0.008 | 0.67 | 0.36 | 0.03 | — | 0.01 | 959 | 154 |
| 12 | 0.24 | 0.90 | 0.26 | 1.07 | 0.02 | — | — | — | 0.94 | — | 0.02 | 0.46 | 939 | 236 |
| 13 | 0.32 | 0.60 | 0.46 | 0.02 | 0.36 | — | — | — | — | 0.67 | 0.48 | — | 867 | 35 |
| 14 | 0.26 | 0.76 | 0.98 | 1.23 | 0.49 | — | — | 0.20 | — | 0.96 | 0.24 | — | 863 | 237 |
| 15 | 0.34 | 2.21 | 0.32 | 0.27 | 0.61 | — | — | 0.01 | 0.03 | — | — | — | 910 | 125 |
| Comparative steel | | | | | | | | | | | | | | |
| 16 | 0.21 | 1.40 | 0.69 | 0.51 | 0.78 | — | — | — | — | — | — | — | 887 | 166 |
| 17 | 0.12 | 2.65 | 0.57 | 0.33 | 0.57 | — | — | — | — | — | — | — | 965 | 105 |
| 18 | 0.24 | 0.69 | 0.72 | 1.15 | 0.21 | 0.03 | 0.86 | — | 0.52 | 1.15 | — | — | 957 | 403 |
| 19 | 0.08 | 0.45 | 0.16 | 0.52 | 0.25 | 1.15 | — | — | — | — | 0.54 | — | 862 | 24 |
| 20 | 0.20 | 1.71 | 1.58 | 0.75 | 0.34 | — | — | 0.74 | — | — | — | 0.53 | 870 | 257 |
| 21 | 0.33 | 0.56 | 0.26 | 2.58 | 0.03 | 0.20 | 0.13 | 0.35 | — | — | — | — | 841 | 144 |
| 22 | 0.25 | 1.26 | 0.25 | 0.35 | 0.25 | 2.15 | 2.20 | — | 1.03 | 0.15 | — | — | 993 | 389 |
| 23 | 0.15 | 1.77 | 2.66 | 0.08 | 0.02 | — | 0.015 | — | — | — | 0.17 | — | 840 | 84 |
| Conventional Steel | | | | | | | | | | | | | | |
| 24 | 0.20 | 0.23 | 1.43 | 0.51 | 0.02 | — | — | — | — | — | — | — | 791 | 53 |
| 25 | 0.21 | 0.22 | 0.78 | 1.15 | 0.17 | 0.03 | 0.022 | — | — | — | 0.02 | — | 806 | 80 |
| 26 | 0.20 | 0.24 | 0.55 | 0.52 | 0.18 | 1.72 | 0.029 | — | — | — | — | — | 798 | 62 |
| 27 | 0.35 | 0.25 | 0.79 | 1.12 | 0.16 | — | — | — | — | — | — | — | 780 | 101 |

TABLE 2

| No. | Depth of grain boundary oxide layer (μm) | Depth of insufficient quenched layer (μm) | Depth of effective hard layer (mm) | Core strength N/mm² | Impact strength J/cm² | Ferrite area percentage (%) | Quenching distortion (%) Average | Quenching distortion (%) Dispersion | Rotational bending fatigue strength (N/mm²) | Gear fatigue durable torque (Nm) | Occurrence of chipping Yes or No |
|---|---|---|---|---|---|---|---|---|---|---|---|
| Steel of the invention | | | | | | | | | | | |
| 1 | 1 | 0 | 0.60 | 985 | 67 | 14 | 0 | 0 | 740 | 325 | No |
| 2 | 1 | 0 | 0.62 | 1030 | 95 | 18 | 0.15 | 0.02 | 755 | 350 | No |
| 3 | 2 | 0 | 0.66 | 1090 | 84 | 63 | 0.24 | 0.03 | 770 | 355 | No |
| 4 | 2 | 0 | 0.86 | 1275 | 85 | 22 | 0.09 | 0.01 | 790 | 380 | No |
| 5 | 1 | 0 | 0.70 | 1210 | 115 | 42 | 0.90 | 0.10 | 785 | 370 | No |
| 6 | 2 | 0 | 0.63 | 1070 | 75 | 25 | 0.45 | 0.04 | 765 | 350 | No |
| 7 | 1 | 0 | 0.70 | 1120 | 127 | 38 | 0.75 | 0.07 | 775 | 365 | No |
| 8 | 2 | 0 | 0.81 | 1240 | 88 | 35 | 0.51 | 0.06 | 780 | 375 | No |
| 9 | 1 | 0 | 0.62 | 960 | 67 | 53 | 0.02 | 0 | 760 | 340 | No |
| 10 | 2 | 0 | 0.65 | 1150 | 95 | 45 | 0.38 | 0.05 | 775 | 360 | No |
| 11 | 2 | 0 | 0.75 | 1175 | 84 | 69 | 0.43 | 0.04 | 780 | 365 | No |
| 12 | 2 | 0 | 0.94 | 1300 | 70 | 57 | 0.96 | 0.11 | 800 | 375 | No |
| 13 | 1 | 0 | 0.51 | 930 | 76 | 16 | 0 | 0 | 740 | 320 | No |
| 14 | 1 | 0 | 0.75 | 1250 | 85 | 30 | 0.70 | 0.07 | 785 | 380 | No |
| 15 | 2 | 0 | 0.63 | 1060 | 75 | 32 | 0.22 | 0.03 | 770 | 360 | No |
| Comparable steel | | | | | | | | | | | |
| 16 | 2 | 1 | 0.74 | 1155 | 82 | 36 | 1.30 | 0.27 | 780 | 370 | No |
| 17 | 4 | 2 | 0.63 | 865 | 34 | 75 | 0.26 | 0.09 | 665 | 270 | Yes |
| 18 | 6 | 4 | 1.07 | 1230 | 38 | 65 | 2.90 | 0.88 | 685 | 250 | Yes |
| 19 | 11 | 8 | 0.40 | 800 | 66 | 35 | 0.05 | 0.02 | 665 | 245 | Yes |
| 20 | 2 | 1 | 0.86 | 1180 | 44 | 26 | 1.08 | 0.22 | 705 | 290 | Yes |
| 21 | 6 | 4 | 0.71 | 1055 | 43 | 5 | 2.70 | 0.78 | 695 | 260 | Yes |
| 22 | 3 | 2 | 1.16 | 1310 | 66 | 81 | 2.55 | 0.76 | 715 | 285 | Yes |
| 23 | 18 | 15 | 0.59 | 1020 | 33 | 7 | 2.40 | 0.78 | 730 | 305 | No |
| Conventional steel | | | | | | | | | | | |
| 24 | 16 | 15 | 0.55 | 995 | 68 | 6 | 2.38 | 0.70 | 685 | 285 | Yes |
| 25 | 19 | 17 | 0.61 | 1090 | 85 | 6 | 2.70 | 0.71 | 680 | 290 | Yes |
| 26 | 14 | 12 | 0.59 | 975 | 89 | 7 | 2.55 | 0.76 | 720 | 295 | Yes |
| 27 | 16 | 14 | 0.84 | 1180 | 43 | 4 | 3.45 | 1.03 | 730 | 305 | Yes |

EMBODIMENT-2

The steel for forming a gear of this invention consists essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, 0.01 to 2 wt. % Ni, and the balance being Fe and inevitable impurities. The steel has an $Ac_3$ point parameter ($Ac_3$) and an ideal critical diameter ($D_I$), both of which are defined by the following equations. The $Ac_3$ point parameter ($Ac_3$) is in a range of from 850° to 960° C., and the ideal critical diameter ($D_I$) is in a range of from 30 to 250 mm. The steel has a non-carburized portion after carburizing and quenching, and the internal structure of the non-carburized portion consists of a dual phase of martensite containing ferrite at a range of from 10 to 70%. The distortion of a Navy C specimen after the carburizing and quenching is 1% or less.

$$Ac_3=920-203\sqrt{C}+44.7\times Si+31.5\times Mo-30\times Mn-11\times Cr-15.2\times Ni$$

$$D_I=7.95\sqrt{C}(1+0.70\times Si)\ (1+3.3\times Mn)\ (1+2.16\times Cr)\ (1+3.0\times Mo)\ (1+0.36\times Ni)$$

The steel may further contain at least one element selected from the group consisting of 0.01 to 0.7 wt. % W, 0.01 to 1 wt. % V, 0.005 to 2 wt. % Al, 0.005 to 1 wt. % Ti, 0.005 to 0.5 wt. % Nb, and 0.005 to 0.5 wt. % Zr. In this case, the steel has an $Ac_3$ point parameter ($Ac_3$) and an ideal critical diameter ($D_I$), both of which are defined by the following equations. The $Ac_3$ point parameter ($Ac_3$) is in a range of from 850° to 960° C., and the ideal critical diameter ($D_I$) is in a range of from 30 to 250 mm.

$$Ac_3=920-203\sqrt{C}+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)\ (1+3.3\times Mn)\ (1+2.16\times Cr)\ (1+3.0\times Mo)\ (1+0.36\times Ni)\ (1+5.0\times V)$$

According to the invention, increase of content of Si, Mo, Al, V, and Ti which are the element of increasing $Ac_3$ transformation temperature and improving hardenability easily forms ferrite-martensite dual phase structure during the carburizing and quenching stage. The formed ferrite absorbs the expansion distortion of martensite to significantly reduce the degree of quenching distortion, and further secures the core hardness during the quenching stage, so a fatigue strength similar to the conventional steel is obtained.

Gears for automobile are often subjected to shot peening to improve the fatigue strength. Since the steel of this invention reduces the surface grain boundary oxide layer and prevents the generation of insufficiently quenched structure, the shot peening does not deteriorate the surface roughness, and the presence of Si, Mo, W, and V increases the tempering softening resistance, which then results in an improved fatigue strength of a tooth face.

The reasons to limit the chemical composition of the steel for forming gear of this invention to a range described above is the same as described in EMBODIMENT-1.

EXAMPLE 2

The present invention is described in the following referring to examples and comparative examples.

Ingots allotted by No. 1 through No. 27 were prepared, each of which has the composition listed in Table 3. The ingots No. 1 through No. 15 are the steel of the present invention having the chemical composition, the $Ac_3$ point parameter, and the ideal critical diameter $D_I$ within the limit of the present invention. The ingots No. 16 through No. 23 are the comparative steels giving at least one of the chemical composition, the $Ac_3$ point parameter, and the ideal critical diameter $D_I$ is outside of the limit of the present invention. The ingots No. 24 through No. 27 are the conventional steels.

Comparative steel No. 16 contains larger amount of Mo than the limit of the invention. Comparative steel No. 17 contains larger amount of Si than the limit of the invention, and the $Ac_3$ point parameter is as high as 965° C.

Comparative steel No. 18 contains larger amount of Ti than the limit of the invention, and the ideal critical diameter $D_I$ also exceeds the limit of the invention. Comparative steel No. 19 contains smaller amount of C, Si, and Mn than the limit of the invention, and the ideal critical diameter $D_I$ is below the limit of the invention. Comparative steel No. 20 contains larger amount of W than the limit of the invention, and the ideal critical diameter $D_I$ also exceeds the limit of the invention. Comparative steel No. 21 contains larger amount of C and Cr than the limit of the invention, so the $Ac_3$ point parameter is lower than the limit of the invention. Comparative steel No. 22 contains larger amount of Al, Ni, and V than the limit of the invention, and the $Ac_3$ point parameter is as high as 997° C. Comparative steel No. 23 contains larger amount of Mn than the limit of the invention, and the $Ac_3$ point parameter is as low as 842° C.

Conventional steels No. 24 through No. 27 are ordinary JIS steels. Conventional steel No. 24 is JIS SMnC420. Conventional steel No. 25 is JIS SCM420. Conventional steel No. 26 is JIS SNCM420. Conventional steel No. 27 is JIS SCM435. All of these conventional steels contain less Si and lower $Ac_3$ point parameter than the limit of the invention.

The ingots of above-described steels of the present invention, the comparative steels, and the conventional steels were hot-rolled to prepare round rods of 20 to 90 mm in diameter. The rods were subjected to normalizing, then they were cut to obtain the quenching distortion test pieces and the fatigue test pieces. These test pieces were treated by carburizing and tempering. Thus treated pieces were tested to determine the degree of carburizing distortion, the rotational bending fatigue characteristics, and the gear fatigue characteristics. With the rods of 20 mm of diameter, carburizing and tempering were given, then the tensile test pieces and the impact test pieces were prepared to determine the strength and the toughness.

Table 3 and Table 4 show the followings. Comparative steel No. 16 contains larger amount of Mo than the limit of the invention, so the quench distortion exceeds 1%. Comparative steel No. 17 contains larger amount of Si than the limit of the invention, so the sufficient strength cannot be secured, and the rotational bending fatigue strength and the gear fatigue durable torque are low. Comparative steel No. 18 contains larger amount of Ti than the limit of the invention, so the core impact strength is low. In addition, the ideal critical diameter $D_I$ is also larger than the limit of the invention, so the quenching distortion becomes large. Comparative steel No. 19 contains less C, Si, and Mn than the limit of the invention, and the ideal critical diameter $D_I$ also less than the limit of the invention, so the sufficient strength cannot be secured, and the rotational bending fatigue strength and the gear fatigue durable torque are low. In addition, Zr content exceeds the limit of the invention, so the impact strength is low. Comparative steel No. 20 contains larger amount of W than the limit of the invention, and the ideal critical diameter $D_I$ is larger than the limit of the invention, so the quenching distortion exceeds 1%. In addition, the Nb content is also higher than the limit of the invention, so the impact strength is low. Comparative steel No. 21 contains larger amount of C and Cr than the limit of the invention, so the $Ac_3$ point parameter is low, and the quenching distortion becomes large. Comparative steel No. 22 contains larger amount of Al than the limit of the invention, so the core impact strength becomes low. In addition, the content of Ni and V are also higher than the limit of the invention, and the ideal critical diameter $D_I$ becomes so large that the quenching distortion becomes large. Comparative steel No. 23 contains larger amount of Mn than the limit of the invention, and the $Ac_3$ point parameter is less than the limit of the invention, so the ferrite area percentage becomes less than 10%, which results in a large quenching distortion.

Conventional steels No. 24 through No. 27 have a ferrite area percentage ranging from 4 to 7%, less than the limit of the invention, so the depth of a grain boundary oxide layer and the depth of an insufficient quenching layer are large, and the quenching distortion is large.

Figure 5:
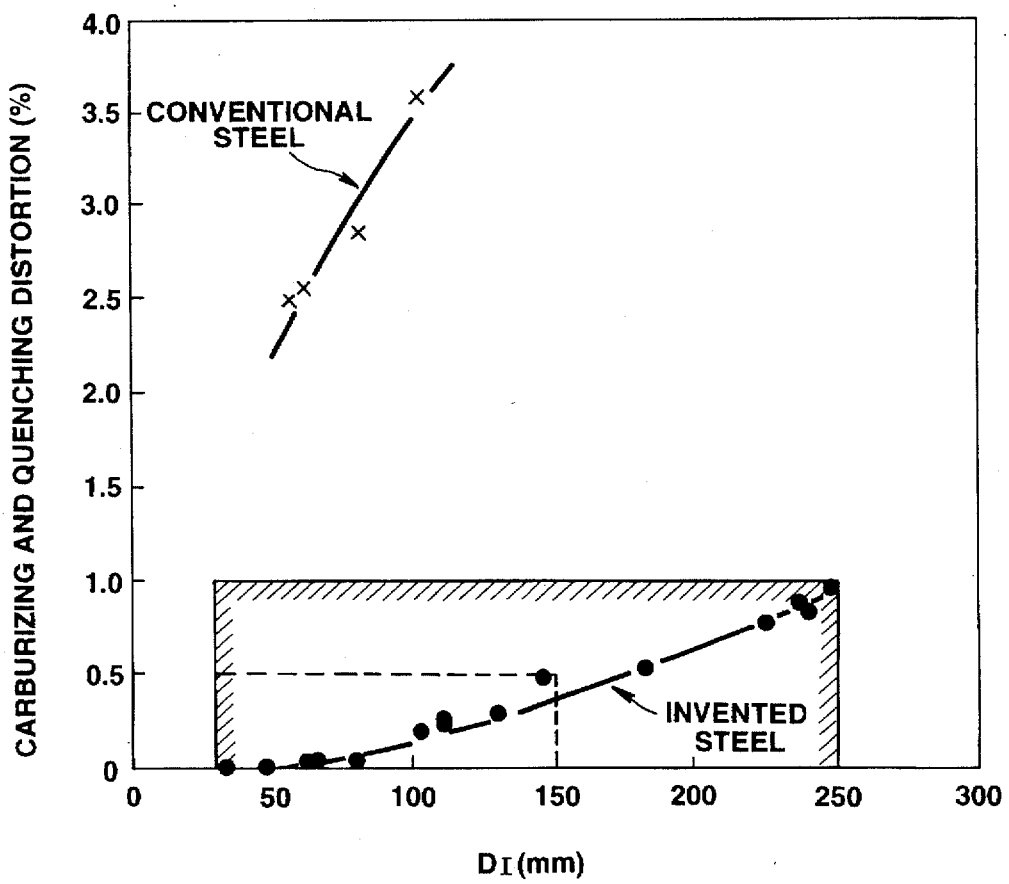
FIG. 5 shows the relation between the ideal critical diameter ($D_I$) and the carburizing and quenching distortion for each of conventional steels and steels of the present invention dealt in EMBODIMENT-2.

To the contrary, compared with the conventional steels, the steels of the invention No. 1 through No. 15 significantly decrease the grain boundary oxide layer, and no insufficient quenched layer is observed, and the carburization characteristics such as the effective hard layer depth of carburization, the core strength, and the impact strength are equivalent or even higher than those of conventional steels. In addition, the steels of this invention have a ferrite-martensite dual phase structure containing 12 to 68% of ferrite, so the quenching distortion is as small as 0 to 1%, and the dispersion within a lot is small. FIG. 5 shows the relation between the ideal critical diameter $D_I$ and the carburizing distortion for each of the steels of this invention and the conventional steels. The figure shows that the present invention significantly diminishes the heat treatment distortion to a level of from zero distortion to about 40% of the value of conventional steels.

Table 3 and Table 4 show that comparative steels No. 17 through No. 22 and conventional steels No. 24 through No. 27 generate pitting on the tooth surface in a low torque region. On the contrary, steels of this invention No. 1 through No. 15 have superior fatigue strength and dedendum strength to conventional steels, and have no insufficient quenched layer, and the increase of Si content increases the tempering softening resistance, which prevents chipping generation and improves the face pressure strength.

As described above, according to the invention, the carburizing distortion is adjustable in a range of from 0 to 1%, compared with the adjusting range of conventional steels from about 2.5 to 3.6%. Thus, the ordinary carburization produces a steel for forming gears having high dedendum strength. The steel of the invention is suitable for the gears for automobiles without need of tooth shape correction. Even for the gears for construction machines and industrial equipment, which gears need to correct the gear shape after the carburization, the steel of the invention minimizes the carburizing deformation, so there is no need of tooth shape correction. Thus, industrial advantages are provided through the reduction of processing cost and the improvement of productivity.

TABLE 3

| No. | Chemical composition (wt. %) C | Si | Mn | Cr | Mo | Ni | Al | W | V | Ti | Nb | Zr | $Ac_3$ Point Parameter | $D_1$ Value (mm) |
|---|---|---|---|---|---|---|---|---|---|---|---|---|---|---|
| Steel of the Invention | | | | | | | | | | | | | | |
| 1 | 0.21 | 1.40 | 0.62 | 0.50 | 0.02 | 0.05 | — | — | — | — | — | — | 866 | 48 |
| 2 | 0.12 | 0.63 | 0.43 | 0.26 | 0.52 | 1.75 | — | — | — | — | — | — | 851 | 63 |
| 3 | 0.13 | 2.38 | 0.35 | 0.70 | 0.55 | 0.07 | — | — | — | — | — | — | 951 | 112 |
| 4 | 0.28 | 1.31 | 1.05 | 0.15 | 0.69 | 0.01 | — | — | — | — | — | — | 859 | 147 |
| 5 | 0.14 | 2.45 | 0.38 | 2.45 | 0.20 | 0.88 | — | — | — | — | — | — | 908 | 241 |
| 6 | 0.15 | 2.48 | 2.45 | 0.05 | 0.03 | 0.35 | — | — | — | — | — | — | 873 | 104 |
| 7 | 0.20 | 1.60 | 0.65 | 0.48 | 0.20 | 1.95 | — | — | — | — | — | — | 852 | 131 |
| 8 | 0.11 | 0.75 | 1.85 | 0.20 | 0.10 | 0.66 | 1.20 | — | 0.36 | 0.01 | — | — | 907 | 184 |
| 9 | 0.15 | 0.51 | 0.85 | 0.16 | 0.68 | 0.06 | 1.93 | — | — | 0.35 | — | 0.03 | 948 | 66 |
| 10 | 0.13 | 1.97 | 0.27 | 1.45 | 0.03 | 1.04 | 0.035 | — | — | — | — | — | 897 | 80 |
| 11 | 0.15 | 2.45 | 0.22 | 2.40 | 0.03 | 0.05 | — | 0.65 | 0.28 | — | — | — | 955 | 238 |
| 12 | 0.25 | 0.95 | 0.25 | 1.08 | 0.02 | 0.04 | — | — | 0.95 | — | — | 0.45 | 940 | 249 |
| 13 | 0.33 | 0.55 | 0.45 | 0.02 | 0.35 | 0.05 | 1.20 | — | — | 0.78 | 0.46 | — | 903 | 34 |
| 14 | 0.25 | 0.65 | 1.05 | 1.20 | 0.48 | 0.01 | — | 0.35 | — | 0.95 | 0.05 | — | 860 | 227 |
| 15 | 0.34 | 1.05 | 0.31 | 0.52 | 0.60 | 0.15 | 0.012 | 0.02 | 0.02 | — | — | — | 852 | 112 |
| Comparative steel | | | | | | | | | | | | | | |
| 16 | 0.20 | 1.44 | 0.70 | 0.50 | 0.77 | 0.05 | — | — | — | — | — | — | 890 | 166 |
| 17 | 0.12 | 2.75 | 0.55 | 0.35 | 0.51 | 0.16 | — | — | — | — | — | — | 965 | 107 |
| 18 | 0.25 | 0.73 | 0.85 | 1.25 | 0.20 | 0.03 | — | — | 0.52 | 1.15 | — | — | 917 | 492 |
| 19 | 0.08 | 0.45 | 0.16 | 0.52 | 0.25 | 1.12 | 0.02 | — | — | — | — | 0.52 | 863 | 24 |
| 20 | 0.19 | 1.70 | 1.60 | 0.76 | 0.35 | 0.04 | — | 0.75 | — | — | 0.55 | — | 871 | 263 |
| 21 | 0.37 | 1.56 | 0.36 | 2.56 | 0.03 | 0.25 | 0.13 | 0.25 | — | — | — | — | 832 | 172 |
| 22 | 0.27 | 0.55 | 0.25 | 0.35 | 0.25 | 2.15 | 2.10 | — | 1.05 | 0.03 | — | — | 997 | 356 |
| 23 | 0.14 | 1.78 | 2.65 | 0.16 | 0.02 | 0.03 | 0.019 | — | — | — | 0.03 | — | 842 | 94 |
| Conventional Steel | | | | | | | | | | | | | | |
| 24 | 0.21 | 0.24 | 1.44 | 0.52 | 0.03 | 0.01 | — | — | — | — | — | — | 789 | 57 |
| 25 | 0.22 | 0.25 | 0.76 | 1.11 | 0.18 | 0.05 | 0.026 | — | — | — | 0.03 | — | 807 | 82 |
| 26 | 0.21 | 0.26 | 0.56 | 0.51 | 0.17 | 1.68 | 0.025 | — | — | — | — | — | 797 | 62 |
| 27 | 0.34 | 0.23 | 0.81 | 1.08 | 0.18 | 0.04 | 0.031 | — | — | — | — | — | 782 | 103 |

TABLE 4

| No. | Depth of grain boundary oxide layer (μm) | Depth of insufficient quenched layer (μm) | Depth of effective hard layer (mm) | Core strength $N/mm^2$ | Impact strength $J/cm^2$ | Ferrite area percentage (%) | Quenching distortion (%) Average | Dispersion | Rotational bending fatigue strength ($N/mm^2$) | Gear fatigue durable torque (Nm) | Occurrence of chipping Yes or No |
|---|---|---|---|---|---|---|---|---|---|---|---|
| Steel of the invention | | | | | | | | | | | |
| 1 | 2 | 0 | 0.58 | 980 | 68 | 15 | 0 | 0 | 740 | 325 | No |
| 2 | 2 | 0 | 0.62 | 1026 | 72 | 13 | 0.02 | 0 | 750 | 345 | No |
| 3 | 1 | 0 | 0.65 | 1085 | 85 | 65 | 0.25 | 0.03 | 765 | 355 | No |
| 4 | 2 | 0 | 0.60 | 1033 | 83 | 22 | 0.46 | 0.05 | 775 | 365 | No |
| 5 | 2 | 0 | 0.76 | 1167 | 105 | 45 | 0.81 | 0.08 | 785 | 375 | No |
| 6 | 1 | 0 | 0.63 | 1070 | 75 | 28 | 0.18 | 0.03 | 760 | 350 | No |
| 7 | 2 | 0 | 0.72 | 1125 | 125 | 12 | 0.27 | 0.04 | 770 | 360 | No |
| 8 | 1 | 0 | 0.80 | 1250 | 85 | 44 | 0.51 | 0.05 | 780 | 370 | No |
| 9 | 1 | 0 | 0.61 | 990 | 70 | 56 | 0.02 | 0.01 | 750 | 340 | No |
| 10 | 2 | 0 | 0.56 | 985 | 71 | 36 | 0.03 | 0.01 | 740 | 330 | No |
| 11 | 1 | 0 | 0.88 | 1275 | 85 | 68 | 0.86 | 0.09 | 785 | 370 | No |
| 12 | 2 | 0 | 0.95 | 1350 | 68 | 58 | 0.95 | 0.12 | 795 | 380 | No |
| 13 | 1 | 0 | 0.51 | 920 | 75 | 40 | 0 | 0 | 730 | 315 | No |

TABLE 4-continued

| No. | Depth of grain boundary oxide layer (μm) | Depth of insufficient quenched layer (μm) | Depth of effective hard layer (mm) | Core strength N/mm² | Impact strength J/cm² | Ferrite area percentage (%) | Quenching distortion (%) Average | Quenching distortion (%) Dispersion | Rotational bending fatigue strength (N/mm²) | Gear fatigue durable torque (Nm) | Occurrence of chipping Yes or No |
|---|---|---|---|---|---|---|---|---|---|---|---|
| 14 | 2 | 0 | 0.90 | 1265 | 76 | 16 | 0.75 | 0.08 | 780 | 375 | No |
| 15 | 1 | 0 | 0.63 | 1080 | 70 | 31 | 0.21 | 0.03 | 760 | 350 | No |
| Comparable steel | | | | | | | | | | | |
| 16 | 1 | 0 | 0.75 | 1149 | 81 | 35 | 1.25 | 0.25 | 775 | 365 | No |
| 17 | 4 | 1 | 0.62 | 860 | 35 | 76 | 0.25 | 0.08 | 660 | 265 | Yes |
| 18 | 5 | 3 | 1.06 | 1240 | 37 | 45 | 2.85 | 0.86 | 680 | 255 | Yes |
| 19 | 10 | 7 | 0.41 | 820 | 65 | 34 | 0.04 | 0.02 | 670 | 245 | Yes |
| 20 | 2 | 1 | 0.85 | 1280 | 45 | 27 | 1.07 | 0.21 | 700 | 285 | Yes |
| 21 | 5 | 3 | 0.75 | 1200 | 55 | 5 | 2.65 | 0.76 | 720 | 280 | Yes |
| 22 | 4 | 2 | 1.25 | 1070 | 45 | 81 | 2.56 | 0.81 | 710 | 290 | Yes |
| 23 | 17 | 16 | 0.60 | 1005 | 35 | 7 | 2.45 | 0.86 | 735 | 300 | No |
| Conventional steel | | | | | | | | | | | |
| 24 | 15 | 14 | 0.56 | 990 | 69 | 5 | 2.49 | 0.68 | 690 | 290 | Yes |
| 25 | 18 | 16 | 0.60 | 1080 | 83 | 6 | 2.85 | 0.70 | 685 | 285 | Yes |
| 26 | 13 | 12 | 0.58 | 980 | 88 | 7 | 2.56 | 0.75 | 725 | 290 | Yes |
| 27 | 16 | 15 | 0.85 | 1150 | 45 | 4 | 3.56 | 1.05 | 730 | 300 | Yes |

EMBODIMENT-3

The main variable which affects the degree of quenching distortion of a steel for forming a gear is the degree of distortion caused by volumetric expansion which occurs during the transformation from austenite structure to martensite structure. The inventors found that the quenching distortion drastically decreases by the presence of ferrite at a rate of 10 to 70% in the austenite structure during the heating stage before the quenching and by the formation of ferrite-martensite dual phase structure after the carburizing.

To introduce ferrite into austenite structure under a normal carburizing condition, the $Ac_3$ transformation temperature is necessary to raise. In this respect, the inventors studied on the effect of steel components such as Si, Mn, Cr, Mo, Al, and V on the $Ac_3$ transformation temperature, and found that the quenching distortion drastically decreases by adjusting the content of these components. The adjustment easily provides the ferrite-martensite dual phase structure under a normal carburizing condition, strengthens the inside of a gear (non-carburizing portion) owing to the ferrite strengthening elements without decreasing the fatigue strength.

The steel for forming a gear of this invention consists essentially of: 0.1 to 0.35 wt. % C, 0.01 to 2.5 wt. % Si, 0.01 to 2.5 wt. % Al, 0.5 to 2.6 wt. % Si +Al, 0.2 to 2.5 wt. % Mn, 0.01 to 2.5 wt. % Cr, and the balance being Fe and inevitable impurities. The steel has an $Ac_3$ point parameter $Ac_3$ and an ideal critical diameter $D_I$, both of which are defined by the following equations. The $Ac_3$ point parameter $Ac_3$ is in a range of from 850° to 960° C., and the ideal critical diameter $D_I$ is in a range of from 30 to 250 mm. The steel has a non-carburized portion after carburizing, and the internal structure of the non-carburized portion consists of a dual phase of martensite containing ferrite at a range of from 10 to 70%. The distortion of a Navy C specimen after the carburization is 1% or less.

$$Ac_3=920-203\sqrt{C}+44.7\times Si-30\times Mn-11\times Cr+40\times Al$$

$$D_I=7.95\sqrt{C}(1+0.70\times Si)\ (1+3.3\times Mn)\ (1+2.16\times Cr)$$

The steel may further contain at least one element selected from the group of 0.01 to 0.7 wt. % Mo, 0.01 to 2 wt. % Ni, 0.01 to 0.7 wt. % W, 0.01 to 1 wt. % V, 0.005 to 1 wt. % Ti, 0.005 to 0.5 wt. % Nb, and 0.005 to 0.5 wt. % Zr. In this case, the steel has an $Ac_3$ point parameter $Ac_3$ and an ideal critical diameter $D_I$, both of which are defined by the following equations and wherein the $Ac_3$ point parameter $Ac_3$ is in a range of from 850° to 960° C., and the ideal critical diameter $D_I$ is in a range of from 30 to 250 mm.

$$Ac_3=920-203\sqrt{C}+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)\ (1+3.3\times Mn)\ (1+2.16\times Cr)\ (1+3.0\times Mo)\ (1+0.36\times Ni)\ (1+5.0\times V)$$

The reasons to limit the chemical composition of the steel for forming gear of this invention to a range described above is detailed in the following.

(1) Carbon (C)

Carbon is a basic element necessary to assure the core strength during the carburized layer. To perform the function, the necessary content of carbon is 0.10 wt. % or more. The content less than 0.10 wt. % is not favorable because the heat treatment period to obtain an effective depth of carburization is prolonged. The content of carbon above 0.35 wt. % induces deterioration of toughness and of machinability. Accordingly, the content of carbon should be limited to a range of from 0.10 to 0.35 wt. %. The carbon range of 0.15 to 0.25 wt. % is more preferable.

(2) Silicon (Si)

Silicon is an important deoxidizer. To assure the effect as the deoxidizer, the necessary content of silicon is 0.01 wt. % or more. Also silicon is an element for forming ferrite structure, and a relatively inexpensive and effective element for increasing the $Ac_3$ transformation point. The content higher than 2.5 wt. %, however, leads to form excess ferrite. The excess ferrite induces degradation of strength and toughness, and increase of $SiO_2$ inclusion, which degrades the fatigue strength. Consequently, the silicon content should be limited to a range of from 0.01 to 2.5 wt. %. The silicon range of 0.8 to 2.2 wt. % is more preferable.

(3) Aluminum (Al)

Aluminum is an effective element to form AlN by bonding to nitrogen, to form fine grains to reduce the quenching distortion, and to improve toughness and fatigue strength. The necessary content of aluminum to perform the functions is 0.01 wt. % or more. Similar to Manganese, aluminum is a ferrite-forming element, and allows to significantly increase $Ac_3$ transformation point under an economical condition. If, however, the aluminum content exceeds 2.5 wt. %, then the alumina group inclusion increases to degrade toughness and fatigue strength. Consequently, the aluminum content should be limited to a range of from 0.01 to 2.5 wt. %.

(4) Si+Al

At a content of Si+Al less than 0.5 wt. %, the silicon concentration in the surface layer to bond to a slight amount of oxygen in the carburization gas during the carburizing stage is so small that the slight amount of oxygen penetrates deep into the steel body to significantly deepen the grain boundary oxide layer and that the fatigue strength decreases. On the other hand, when the content of Si+Al exceeds 2.6 wt. %, the cleanliness and the toughness of the steel deteriorates. Therefore, the content of Si+Al should be limited to a range of from 0.5 to 2.6 wt. %.

(5) Manganese (Mn)

Manganese is an effective element to improve the hardenability and to secure the core strength. To perform the functions, the necessary silicon content is 0.20 wt. % or more. Manganese, however, has a function to considerably decrease the $Ac_3$ transformation point. So the manganese content above 2.50 wt. % interferes the formation of dual phase structure, and results in excessively high hardness, which leads to the deterioration of machinability. Therefore, the manganese content should be limited to a range of from 0.20 to 2.50 wt. %. The manganese range of 0.5 to 2.0 wt. % is more preferable.

(6) Chromium (Cr)

Chromium is an effective element to improve the hardenability same as manganese. The necessary content of chromium to perform the function is 0.01 wt. % or more. Chromium, however, has a function to considerably decrease the $Ac_3$ transformation point as in the case of manganese. So the chromium content above 2.50 wt. % interferes the formation of dual phase structure, and results in excessively high hardness, which leads to the deterioration of machinability. Therefore, the chromium content should be limited to a range of from 0.01 to 2.50 wt. %. The chromium range of 0.2 to 2 wt. % is more preferable.

(7) Molybdenum (Mo)

Molybdenum is an effective element for increasing $Ac_3$ transformation point and improving hardenability, toughness, and fatigue strength. The necessary content of molybdenum to perform the function is at 0.01 wt. % or more. Molybdenum is, however, an extremely expensive element, and the addition to above 0.70 wt. % saturates its effect and results in an economical disadvantage. So the molybdenum content should be limited to a range of from 0.01 to 0.70 wt. %. The molybdenum range of 0.1 to 0.5 wt. % is more desirable.

(8) Nickel (Ni)

Nickel is an effective element to improve hardenability and toughness. The necessary content of nickel to perform the function is 0.01 wt. % or more. The nickel content above 2.0 wt. %, however, makes the hardness too high and deteriorates the machinability. In addition, nickel is an expensive element so that excessive addition leads to an economical disadvantage. Consequently, the nickel content should be limited to a range of from 0.01 to 2.0 wt. %. The nickel range of 0.1 to 1.5 wt. % is more preferable.

(9) Tungsten (W)

Tungsten is an effective element to increase $Ac_3$ transformation point similar to molybdenum, and improve toughness and fatigue strength. The necessary content of tungsten to perform the function is 0.01 wt. % or more. Tungsten is, however, also expensive, and the addition to above 0.70 wt. % results in an economical disadvantage compared with the enhanced effect. Accordingly, the tungsten content should be limited to a range of from 0.01 to 0.70 wt. %. In the case that tungsten and molybdenum are added simultaneously, the total content of them is preferably at 0.70 wt. % or less. The total content of above 0.70 wt. % is unfavorable because of the increase of carburizing distortion.

(10) Vanadium (V)

Vanadium has a strong effect to increase $Ac_3$ transformation point, and is effective for improving hardenability and fatigue strength. In addition, vanadium has a function to form carbon-nitride, to make grains fine, and to suppress the quenching distortion. The necessary content of vanadium to perform the functions is 0.01 wt. % or more. The vanadium content above 1.0 wt. %, however, saturates the effect and results in an economical disadvantage, and furthermore, results in excess carbon-nitride presence to degrade toughness. Therefore, the vanadium content should be limited to a range of from 0.01 to 1.0 wt. %.

(11) Titanium (Ti)

Titanium is also an element to form ferrite, and has a strong function for increasing $Ac_3$ transformation point. Titanium is an effective element to form fine austenite grains, and to contribute to the increase of fatigue strength by increasing the yield strength at the carburized portion and the inside of steel. The necessary content of titanium to perform the functions is 0.005 wt. % or more. If, however, the titanium content exceeds 1.0 wt. %, then the effect saturates and the economical disadvantage occurs, and furthermore, excess amount of carbon-nitride deteriorates toughness. Therefore, the titanium content should be limited to a range of from 0.005 to 1.0 wt. %.

(12) Niobium (Nb)

Niobium is also an effective element to form fine austenite grains. The necessary content of niobium to perform the function is 0.005 wt. % or more. If, however, the niobium content exceeds 0.50 wt. %, then the effect saturates and the economical disadvantage occurs, and furthermore, excess amount of carbon-nitride deteriorates toughness. Therefore, the niobium content should be limited to a range of from 0.005 to 0.50 wt. %.

(13) Zirconium (Zr)

Zirconium is also an effective element to form fine austenite grains similar to niobium. The necessary content of zirconium to perform the function is 0.005 wt. % or more. If, however, the zirconium content exceeds 0.50 wt. %, then the effect saturates and the economical disadvantage occurs, and furthermore, excess amount of carbon-nitride deteriorates toughness. Therefore, the zirconium content should be limited to a range of from 0.005 to 0.50 wt. %.

Other than the elements described above, the steel of this invention may include P, S, Cu, N, and O as impurities. Among them, N may be added to an amount of up to 0.20 wt. % for forming fine grains. Furthermore, to improve machinability, a free-cutting element such as S, Pb, Ca, and Se may be added.

(14) $Ac_3$ point parameter

FIG. 5 shows an example of heat treatment pattern during carburizing stage. The carburizing is conducted at 900° C. to diffuse carbon into the steel structure. The steel is then held at 850° C., lower temperature than that of the carburizing, to decrease distortion. Finally, the steel is hardened in an oil or other medium. Accordingly, if the $Ac_3$ point parameter calculated from equation (3) is below 850° C., then the steel can not secure ferrite within the austenite structure even when the steel is held at 850° C. after the carburization. On the other hand, if the $Ac_3$ point parameter exceeds 960° C., the ferrite becomes excessive, and the core strength becomes insufficient. Consequently, the $Ac_3$ parameter determined by equation (3) should be limited to a range of from 850° to 960° C. 870° to 930° C. is more preferable.

$$Ac_3=920-203\sqrt{C}+44.7\times Si+31.5\times Mo-30\times Mn-11\times Cr+40\times Al-15.2\times Ni+13.1\times W+104\times V+40\times Ti \quad (3)$$

(15) Ideal critical diameter ($D_I$)

Ideal critical diameter $D_I$ is an index expressing the hardenability of steel. To secure a favorable fatigue strength, the ideal critical diameter $D_I$ calculated by eq. (4) as the austenite grain size number 8 is necessary at 30 mm or more. When the $D_I$ value exceeds 250 mm, the effect of ferrite mixed in the austenite structure is lost, and the quenching distortion becomes large. Consequently, the ideal critical diameter $D_I$ calculated by eq. (4) as the austenite grain size number 8 should be limited to a range of from 30 to 250 mm, and most preferably in a range of from 30 to 150 mm.

$$D_I=7.95\sqrt{C}(1+0.70\times Si)(1+3.3\times Mn)(1+2.16\times Cr)(1+3.0\times Mo)(1+0.36\times Ni)(1+5.0\times V) \quad (4)$$

(16) Amount of ferrite in the internal structure (non-carburized portion)

When the amount of ferrite in the internal structure (non-carburized portion) is less than 10%, the transforming distortion of martensite cannot be fully absorbed, and the quenching distortion cannot be suppressed at a low level. If, however, the amount of ferrite exceeds 70%, then the desired strength and toughness become difficult to attain. Therefore, the amount of ferrite in the internal structure (non-carburized portion) should be limited to a range of from 10 to 70%. 20 to 60% ferrite is more preferable. Further, retained austenite and bainite can be partially included in the martensite.

(17) Deformation on Navy C specimen after carburizing and quenching

The determination of deformation after carburizing and quenching is generally carried out by determining the change of opening on a Navy C specimen shown in FIG. 1. When an adopted steel gives a large distortion such as higher than 1% of deformation after carburizing and quenching on the Navy C specimen, the formed gear shows a large deformation during the carburizing stage. Such gear needs machining to correct the gear tooth shape. Therefore, machining is essential. To allow an as-carburized gear to use, the post-carburization distortion on the Navy C specimen should be 1% or less. The most preferable distortion is 0.5% or less.

EXAMPLE 3

The present invention is described in the following referring to examples and comparative examples.

Ingots allotted by No. 1 through No. 27 were prepared, each of which has the composition listed in Table 5. The ingots No. 1 through No. 15 are the steel of the present invention having the chemical composition, the $Ac_3$ point parameter, and the ideal critical diameter $D_I$ within the limit of the present invention. The ingots No. 16 through No. 23 are the comparative steels giving at least one of the chemical composition, the $Ac_3$ point parameter, and the ideal critical diameter $D_I$ is outside of the limit of the present invention. The ingots No. 24 through No. 27 are the conventional steels.

Comparative steel No. 16 contains larger amount of Cr than the limit of the invention, and the $Ac_3$ parameter is below the limit of the invention. and further the ideal critical diameter $D_I$ exceeds the limit of the invention. Comparative steel No. 17 contains less amount of C and Mn than the limit of the invention, and larger amount of Si than the limit of the invention. In addition, the $Ac_3$ point parameter is larger than the limit of the invention and the ideal critical diameter $D_I$ is less than the limit of the invention. Comparative steel No. 18 contains larger amount of Al and Mn than the limit of the invention. Comparative steel No. 19 contains larger amount of C. Comparative steel No. 20 contains larger amount of Mo than the limit of the invention. Comparative steel No. 21 contains larger amount of Ni and Ti than the limit of the invention, and the $Ac_3$ point parameter is lower than the limit of the invention. Comparative steel No. 22 contains larger amount of W and Nb than the limit of the invention. Comparative steel No. 23 contains larger amount of V and Zr than the limit of the invention.

Conventional steels No. 24 through No. 27 are ordinary JIS steels. Conventional steel No. 24 is JIS SMnC420. Conventional steel No. 25 is JIS SCM420. Conventional steel No. 26 is JIS SNCM420. Conventional steel No. 27 is JIS SCM435. All of these conventional steels contain less Si and lower $Ac_3$ point parameter than the limit of the invention.

The ingots of above-described steels of the present invention, the comparative steels, and the conventional steels were hot-rolled to prepare round rods of 20 to 90 mm in diameter. The rods were subjected to normalizing, then they were cut to obtain the quenching distortion test pieces and the fatigue test pieces. These test pieces were treated by carburizing and tempering. Thus treated pieces were tested to determine the degree of carburizing distortion, rotational bending fatigue characteristics, and gear fatigue characteristics. With the rods of 20 mm of diameter, carburizing and tempering were given, then the tensile test pieces and the impact test pieces were prepared to determine the strength and the toughness.

Table 5 and Table 6 show the followings. Comparative steel No. 16 contains larger amount of Cr than the limit of the invention, and the $Ac_3$ point parameter is lower than the limit of the invention, and the ideal critical diameter $D_I$ is larger than the limit of the invention, so the quench distortion exceeds 1%. Comparative steel No. 17 contains smaller amount of C and Mn than the limit of the invention, and the content of Si is large. In addition, the $Ac_3$ point parameter is larger than the limit of the invention and the ideal critical diameter $D_I$ is less than the limit of the invention, so the ferrite area percentage becomes large to decrease the core strength, the rotational bending fatigue strength, and the gear fatigue durable torque. Comparative steel No. 18 contains larger amount of Al and Mn than the limit of the invention, so the core toughness becomes low. Comparative steel No. 19 contains a large amount of C than the limit of the invention, so the core toughness becomes low. Comparative steel No. 20 contains larger amount of Mo than the limit of the invention, so the quenching distortion exceeds 1%. Comparative steel No. 21 contains larger amount of Ni and Ti than the limit of the invention, so the $Ac_3$ point parameter is lower than the limit of the invention. As a result, the core toughness becomes low and the quenching distortion exceeds 1%. Comparative steel No. 22 contains larger amount of W and Nb than the limit of the invention, so the core toughness, the rotational bending fatigue strength, and the gear fatigue durable torque becomes low. Comparative steel No. 23 contains larger amount of V and Zr than the limit of the invention, so the core toughness, the rotational bending fatigue strength, and the gear fatigue durable torque becomes low.

Conventional steels No. 24 through No. 27 have a ferrite area percentage of 5 to 8%, less than the limit of the invention, so the depth of a grain boundary oxide layer and the depth of an insufficient quenching layer are large, and the quenching distortion is large.

Figure 6:
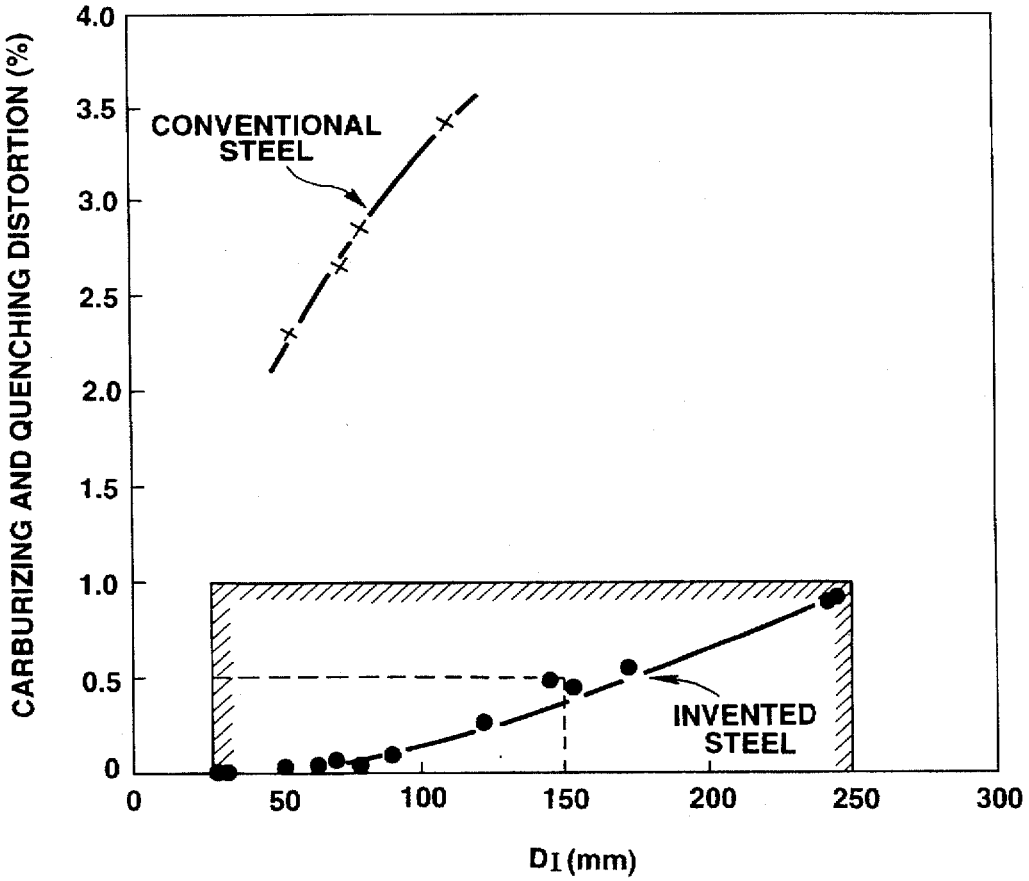
FIG. 6 shows the relation between the ideal critical diameter ($D_I$) and the carburizing and quenching distortion for each of conventional steels and a steels of the present invention dealt in EMBODIMENT-3.

To the contrary, compared with the conventional steels, the steels of the invention No. 1 through No. 15 significantly decrease the grain boundary oxide layer, and no insufficient quenched layer is observed, and the carburization characteristics such as the effective hard layer depth of carburization, the core strength, and the impact strength are equivalent or even higher than those of conventional steels. In addition, the steels of this invention have a ferrite-martensite dual phase structure containing 12 to 68% of ferrite, so the quenching distortion is as small as 0 to 1%, and the dispersion within a lot is small. FIG. 6 shows the relation between the ideal critical diameter $D_I$ and the carburizing distortion for each of the steels of this invention and the conventional steels. The figure shows that the present invention significantly diminishes the heat treatment distortion to a level of from zero distortion to about 40% of the value of conventional steels.

Table 5 and Table 6 show that comparative steels No. 17 through No. 22 and conventional steels No. 24 through No. 27 generate pitting on the tooth surface in a low torque region. On the contrary, steels of this invention No. 1 through No. 15 have superior fatigue strength and dedendum strength to conventional steels, and have no insufficient quenched layer, and the increase of Si content increases the tempering softening resistance, which prevents chipping generation and improves the face pressure strength.

As described above, according to the present invention, the carburizing distortion is adjustable in a range of from 0 to 1%, compared with the adjusting range of conventional steels from about 2.3 to 3.5%. Thus, the ordinary carburization produces a steel for forming gears having high dedendum strength. The steel of the present invention is suitable for the gears for automobiles without need of tooth shape correction. Even for the gears for construction machines and industrial equipment, which gears need to correct the gear shape after the carburization, the steel of the invention minimizes the carburizing distortion, so there is no need of tooth shape correction. Thus, industrial advantages are provided through the reduction of processing cost and the improvement of productivity.

TABLE 5

| | Chemical composition (wt. %) | | | | | | | | | | | | $Ac_3$ Point | $D_1$ Value |
|---|---|---|---|---|---|---|---|---|---|---|---|---|---|---|
| No. | C | Si | Mn | Cr | Mo | Ni | Al | W | V | Ti | Nb | Zr | Parameter | (mm) |
| Steel of the invention | | | | | | | | | | | | | | |
| 1 | 0.25 | 1.48 | 0.03 | 0.86 | 0.68 | — | — | — | — | — | — | — | 852 | 77 |
| 2 | 0.12 | 0.14 | 2.45 | 0.43 | 1.45 | — | — | — | — | — | — | — | 925 | 30 |
| 3 | 0.32 | 2.43 | 0.11 | 1.80 | 0.34 | — | — | — | — | — | — | — | 869 | 146 |
| 4 | 0.14 | 1.45 | 1.01 | 0.22 | 2.43 | — | — | — | — | — | — | — | 915 | 65 |
| 5 | 0.19 | 2.48 | 0.06 | 2.42 | 0.03 | — | — | — | — | — | — | — | 871 | 91 |
| 6 | 0.13 | 2.46 | 0.05 | 1.25 | 2.39 | — | — | — | — | — | — | — | 894 | 246 |
| 7 | 0.11 | 2.49 | 0.02 | 0.35 | 0.45 | — | — | — | — | — | — | — | 949 | 31 |
| 8 | 0.19 | 2.24 | 0.20 | 0.46 | 0.75 | 0.65 | — | — | — | — | — | — | 938 | 173 |
| 9 | 0.13 | 1.75 | 0.75 | 0.86 | 0.15 | — | 1.88 | — | — | — | — | — | 899 | 54 |
| 10 | 0.20 | 0.45 | 0.35 | 0.34 | 0.25 | 0.35 | 0.21 | — | — | — | — | — | 858 | 34 |
| 11 | 0.12 | 0.05 | 2.46 | 0.86 | 0.68 | 0.56 | — | — | — | — | 0.03 | — | 934 | 72 |
| 12 | 0.18 | 1.66 | 0.03 | 0.65 | 0.76 | 0.03 | — | 0.66 | — | 0.03 | — | 0.02 | 892 | 66 |
| 13 | 0.15 | 2.10 | 0.11 | 2.14 | 0.64 | — | — | 0.12 | 0.01 | 0.85 | 0.46 | — | 905 | 153 |
| 14 | 0.16 | 2.11 | 0.51 | 0.25 | 1.30 | — | — | — | 0.25 | — | — | 0.25 | 957 | 123 |
| 15 | 0.29 | 1.35 | 0.66 | 0.68 | 0.03 | 0.16 | — | — | 0.94 | — | 0.15 | 0.45 | 955 | 243 |
| Comparative steel | | | | | | | | | | | | | | |
| 16 | 0.22 | 1.66 | 0.05 | 1.21 | 2.61 | — | — | — | — | — | — | — | 835 | 267 |
| 17 | 0.09 | 2.66 | 0.12 | 0.18 | 0.66 | — | — | — | — | — | — | — | 970 | 26 |
| 18 | 0.12 | 0.22 | 2.56 | 2.63 | 0.05 | — | — | — | — | — | — | — | 882 | 34 |
| 19 | 0.37 | 1.76 | 0.68 | 0.72 | 0.45 | — | — | — | — | — | — | — | 875 | 72 |
| 20 | 0.18 | 0.82 | 2.15 | 1.54 | 0.52 | 0.76 | 0.02 | — | — | — | — | — | 928 | 226 |
| 21 | 0.25 | 0.60 | 0.35 | 0.81 | 0.43 | — | 2.18 | — | — | 1.11 | — | — | 841 | 71 |
| 22 | 0.19 | 2.41 | 0.03 | 1.32 | 1.55 | 0.03 | 0.06 | 0.75 | — | — | 0.57 | — | 893 | 241 |
| 23 | 0.21 | 0.48 | 0.36 | 0.54 | 0.43 | — | — | — | 1.09 | — | 0.05 | 0.55 | 955 | 168 |
| Conventional Steel | | | | | | | | | | | | | | |
| 24 | 0.21 | 0.24 | — | 1.50 | 0.56 | — | — | — | — | — | — | — | 786 | 56 |
| 25 | 0.19 | 0.25 | 0.03 | 0.82 | 1.12 | 0.19 | — | — | — | — | 0.04 | — | 813 | 81 |
| 26 | 0.22 | 0.28 | 0.04 | 0.55 | 0.57 | 0.20 | 1.78 | — | — | — | — | — | 795 | 74 |
| 27 | 0.36 | 0.25 | 0.03 | 0.79 | 1.15 | 0.19 | — | — | — | — | — | — | 780 | 111 |

TABLE 6

| No. | Depth of grain boundary oxide layer (μm) | Depth of insufficient quenched layer (μm) | Depth of effective hard layer (mm) | Core strength N/mm² | Impact strength J/cm² | Ferrite area percentage (%) | Quenching distortion (%) Average | Quenching distortion (%) Dispersion | Rotational bending fatigue strength (N/mm²) | Gear fatigue durable torque (Nm) | Occurrence of chipping Yes or No |
|---|---|---|---|---|---|---|---|---|---|---|---|
| Steel of the invention | | | | | | | | | | | |
| 1 | 2 | 0 | 0.57 | 985 | 76 | 12 | 0.03 | 0.01 | 740 | 330 | No |
| 2 | 2 | 0 | 0.52 | 920 | 80 | 51 | 0 | 0 | 730 | 315 | No |
| 3 | 2 | 0 | 0.60 | 1035 | 88 | 17 | 0.46 | 0.05 | 775 | 360 | No |
| 4 | 1 | 0 | 0.62 | 1025 | 85 | 44 | 0.02 | 0 | 750 | 345 | No |
| 5 | 2 | 0 | 0.60 | 990 | 95 | 26 | 0.08 | 0.03 | 750 | 350 | No |
| 6 | 2 | 0 | 0.76 | 1180 | 105 | 31 | 0.90 | 0.11 | 795 | 380 | No |
| 7 | 2 | 0 | 0.53 | 920 | 85 | 64 | 0 | 0 | 735 | 320 | No |
| 8 | 1 | 0 | 0.65 | 1050 | 94 | 52 | 0.53 | 0.05 | 780 | 370 | No |
| 9 | 2 | 0 | 0.58 | 940 | 96 | 30 | 0.02 | 0 | 740 | 325 | No |
| 10 | 1 | 0 | 0.55 | 930 | 95 | 16 | 0 | 0 | 785 | 365 | No |
| 11 | 2 | 0 | 0.57 | 980 | 98 | 51 | 0.05 | 0.01 | 735 | 330 | No |
| 12 | 1 | 0 | 0.58 | 975 | 95 | 32 | 0.03 | 0.01 | 730 | 320 | No |
| 13 | 2 | 0 | 0.65 | 1045 | 93 | 48 | 0.42 | 0.04 | 780 | 365 | No |
| 14 | 1 | 0 | 0.61 | 1040 | 84 | 68 | 0.25 | 0.02 | 765 | 360 | No |
| 15 | 2 | 0 | 0.80 | 1200 | 78 | 65 | 0.87 | 0.07 | 780 | 360 | No |
| Comparable steel | | | | | | | | | | | |
| 16 | 2 | 1 | 0.85 | 1300 | 55 | 7 | 1.15 | 0.21 | 705 | 310 | No |
| 17 | 4 | 3 | 0.48 | 880 | 120 | 76 | 0 | 0 | 680 | 280 | Yes |
| 18 | 5 | 4 | 0.52 | 920 | 85 | 28 | 2.10 | 0.56 | 690 | 265 | Yes |
| 19 | 11 | 10 | 0.65 | 1020 | 35 | 24 | 0.03 | 0.01 | 710 | 295 | Yes |
| 20 | 4 | 3 | 0.76 | 1150 | 45 | 52 | 1.15 | 0.12 | 700 | 285 | Yes |
| 21 | 6 | 5 | 0.64 | 1010 | 44 | 8 | 2.10 | 0.70 | 690 | 270 | Yes |
| 22 | 3 | 2 | 0.81 | 1250 | 34 | 44 | 0.94 | 0.15 | 700 | 280 | Yes |
| 23 | 14 | 12 | 0.85 | 1200 | 37 | 69 | 0.95 | 0.14 | 710 | 295 | No |
| Conventional steel | | | | | | | | | | | |
| 24 | 16 | 15 | 0.58 | 990 | 64 | 5 | 2.30 | 0.85 | 685 | 285 | Yes |
| 25 | 17 | 16 | 0.63 | 1090 | 82 | 7 | 2.85 | 0.90 | 690 | 300 | Yes |
| 26 | 18 | 14 | 0.60 | 985 | 85 | 8 | 2.65 | 0.75 | 705 | 290 | Yes |
| 27 | 16 | 15 | 0.83 | 1140 | 42 | 6 | 3.40 | 1.12 | 720 | 305 | Yes |

What is claimed is:

1. A steel gear having been carburized on a quenched said steel gear formed from a steel composition consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, and the balance being Fe and inevitable impurities;

said steel composition having an $Ac_3$ point parameter ($Ac_3$) of 850° to 960° C. and an ideal critical diameter ($D_I$) of 30 to 250 mm, the $Ac_3$ point parameter ($Ac_3$) and the ideal critical diameter ($D_I$) being defined by the following equations;

$$A_3=920-203\sqrt{C}+44.7\times Si+31.5\times Mo-30\times Mn-11\times Cr$$

$$D_I=7.95\sqrt{C}(1+0.70\times Si)\ (1+3.3\times Mn)\ (1+2.16\times Cr)\ (1+3.0\times Mo)$$

, said steel gear having a non-carburized internal structure comprising martensite and 10 to 70 area % ferrite in a dual phase; and said steel gear having a distortion of a Navy C specimen of 1% or less.

2. The steel gear of claim 1, wherein the C content is from 0.15 to 0.25 wt. %.

3. The steel gear of claim 1, wherein the Si content is from 0.8 to 2.2 wt. %.

4. The steel gear of claim 1, wherein the Mn content is from 0.5 to 2 wt. %.

5. The steel gear of claim 1, wherein the Cr content is from 0.2 to 2 wt. %.

6. The steel gear of claim 1, wherein the Mo content is from 0.1 to 0.5 wt. %.

7. The steel gear of claim 1, wherein the $Ac_3$ point parameter ($Ac_3$) is from 870° to 930° C.

8. The steel gear of claim 1, wherein the ideal critical diameter ($D_I$) is from 30 to 150 mm.

9. The steel gear of claim 1, wherein the area percentage of ferrite is from 20 to 60%.

10. A steel gear having been carburized and quenched said steel gear formed from a steel composition consisting essentially of 0.1 to 0.35 wt. % C, 0.5 to 2.5 wt. % Si, 0.2 to 2.5 wt. % Mn, 0.01 to 2.5 wt. Cr, 0.01 to 0.7 wt. % Mo, at least one element selected from the group consisting of 0.01 to 2 wt. % Ni, 0.01 to 0.7 wt. % W, 0.01 to 1 wt. % V, 0.005 to 2 wt. % Al, 0.005 to 1 wt. % Ti, 0.005 to 0.5 wt. % Nb and 0.005 to 0.5 wt. % Zr, and the balance being Fe and inevitable impurities;

said steel composition having an $Ac_3$ point parameter ($Ac_3$) of 850° to 960° C. and an ideal critical diameter ($D_I$) of 30 to 250 mm, the $Ac_3$ point parameter ($Ac_3$) and the ideal critical diameter ($D_I$) being defined by the following equations;

$$Ac_3=920-203\sqrt{C}+44.7\times Si+31.5\times Mo-30\times Mn-11\times Cr+40\times Al-15.2\times Ni+13.1\times W+40\times Ti$$

$$D_I=7.95\sqrt{C}(1+0.70\times Si)(1+3.3\times Mn)(1+2.16\times Cr)(1+3.0\times Mo)(1+0.36\times Ni)(1+5.0\times V)$$

, said steel gear having a non-carburized internal structure comprising martensite and 10 to 70 area % ferrite in a dual phase; and said steel gear having a distortion of a Navy C specimen of 1% or less.

11. Steel for forming a gear by carburizing and quenching consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, at least one element selected from the group consisting of 0.01 to 2 wt. % Ni, 0.01 to 0.7 wt. % W, 0.01 to 1 wt. % V, 0.005 to 2 wt. % Al, 0.005 to 1 wt. % Ti, 0.005 to 0.5 wt. % Nb and 0.005 to 0.5 wt. % Zr, and the balance being Fe and inevitable impurities;

said steel having an $Ac_3$ point parameter ($Ac_3$) and an ideal critical diameter ($D_I$), said $Ac_3$ point parameter being in a range of 850° to 960° C., said ideal critical diameter ($D_I$) being in a range of 30 to 250 mm, and the $Ac_3$ point parameter ($Ac_3$) and the ideal critical diameter ($D_I$) being defined by the following equations;

$$Ac_3=920-203\sqrt{C}+44.7\times Si+31.5\times Mo-30\times Mn-11\times Cr+40\times Al-15.2\times Ni+13.1\times W+40\times Ti$$

$$D_I=7.95\sqrt{C}(1+0.70\times Si)(1+3.3\times Mn)(1+2.16\times Cr)(1+3.0\times Mo)(1+0.36\times Ni)(1+5.0\times V)$$

said steel having a non-carburized portion after carburizing and quenching, an internal structure of the non-carburized portion comprising a dual phase of martensite and ferrite, said ferrite having an area percentage of 10 to 70% in the dual phase; and said steel having a distortion of a Navy C specimen after the carburizing and quenching, said distortion being 1% or less.

12. The steel gear of claim 11, wherein said at least one element is 0.01 to 2 wt. % Ni.

13. The steel gear of claim 11, wherein said at least one element are 0.01 to 2 wt. % Ni and 0.005 to 2 wt. % Al.

14. The steel gear of claim 11, wherein said at least one element is selected from the group consisting of 0.01 to 2 wt. % Ni, 0.005 to 2 wt. % Al, and 0.005 to 0.5 wt. % Zr.

15. The steel gear of claim 11, wherein said at least one element is 0.005 to 2 wt. % Al.

16. The steel gear of claim 11, wherein said at least one element is 0.01 to 0.7 wt. % W.

17. The steel gear of claim 11, wherein said at least one element is 0.01 to 1 wt. % V.

18. The steel gear of claim 11, wherein said at least one element is 0.005 to 1 wt. % Ti.

19. The steel gear of claim 11, wherein said at least one element is selected from the group of 0.005 to 1 wt. % Ti and 0.005 to 0.5 wt. % Nb.

20. The steel gear of claim 11, wherein said at least one element is 0.005 to 0.5 wt. % Nb.

21. The steel gear of claim 11, wherein said at least one element is 0.005 to 0.5 wt. % Zr.

22. The steel gear of claim 11, wherein the $Ac_3$ point parameter ($Ac_3$) is from 870° to 930° C.

23. The steel gear of claim 11, wherein the ideal critical diameter ($D_I$) is from 30 to 150 mm.

24. The steel gear of claim 11, wherein the area percentage of ferrite is from 20 to 60%.

25. The steel gear of claim 11, wherein the steel gear has a distortion from 0 to 0.5 %.

26. A steel gear having been carburized and quenched, said steel gear formed from a steel composition consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, 0.01 to 2 wt. % Ni, and the balance being Fe and inevitable impurities;

said steel composition having an $Ac_3$ point parameter ($Ac_3$) of 850° to 960° C. and an ideal critical diameter ($D_I$) of 30 to 250 mm, the $Ac_3$ point parameter ($Ac_3$) and the ideal critical diameter ($D_I$) being defined by the following equations:

$$Ac_3=920-203\sqrt{C}+44.7\times Si+31.5\times Mo-30\times Mn-11\times Cr-15.2\times Ni$$

$$D_I=7.95\sqrt{C}(1+0.70\times Si)(1+3.3\times Mn)(1+2.16\times Cr)(1+3.0\times Mo)(1+0.36\times Ni)$$

, said steel gear having a non-carburized internal structure comprising martensite and 10 to 70 area a ferrite in a dual phase; and said steel gear having a distortion of a Navy C specimen of 1% or less.

27. The steel gear of claim 26, wherein the C content is from 0.15 to 0.25 wt. %.

28. The steel gear of claim 26, wherein the Si content is from 0.8 to 2.2 wt. %.

29. The steel gear of claim 26, wherein the Mn content is from 0.5 to 2 wt. %.

30. The steel gear of claim 26, wherein the Cr content is from 0.2 to 2 wt. %.

31. The steel gear of claim 26, wherein the Mo content is from 0.1 to 0.5 wt. %.

32. The steel gear of claim 26, wherein the Ni content is from 0.1 to 1.5 wt. %.

33. The steel gear of claim 26, wherein the $Ac_3$ point parameter ($Ac_3$) is from 870° to 930° C.

34. The steel gear of claim 26, wherein the ideal critical diameter ($D_I$) is from 30 to 150 mm.

35. The steel gear of claim 26, wherein the area percentage of ferrite is from 20 to 60%.

36. The steel gear of claim 26, wherein the steel gear has a distortion from 0 to 0.5%.

37. A steel gear having been carburized and quenched said steel gear formed from a steel composition consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, 0.01 to 2 wt. % Ni, and at least one element selected from the group of 0.01 to 0.7 wt. % W, 0.01 to 1.0 wt. % V, 0.005 to 2.0 wt. % Al, 0.005 to 1.0 wt. % Ti, 0.005 to 0.5 wt. % Nb, and 0.005 to 0.50 wt. % Zr, and the balance being Fe and inevitable impurities;

said steel composition having an $Ac_3$ point parameter ($Ac_3$) of 850° to 960° C. and an ideal critical diameter ($D_I$) 30 to 250 mm, the $Ac_3$ point parameter ($Ac_3$) and the ideal critical diameter ($D_I$) being defined by the following equations:

$$Ac_3=920-203\sqrt{C}C+44.7\times Si+31.5\times Mo-30\times Mn-11\times Cr+40\times Al-15.2\times Ni+13.1\times W+104\ X\ V+40\times Ti$$

$$D_I=7.95\sqrt{C}(1+0.70\times Si)(1+3.3\times Mn)(1+2.16\times Cr)(1+3.0\times Mo)(1+0.36\times Ni)(1+5.0\times V)$$

, said steel rear having a non-carburized internal structure comprising martensite and 10 to 70 area % ferrite in a dual phase; and said steel rear having a distortion of a Navy C specimen of 1% or less.

38. The steel gear of claim 37, wherein said at least one element is 0.005 to 2 wt. % Al.

39. The steel gear of claim 37, wherein said at least one element is selected from the group of 0.005 to 2 wt. % Al, 0.01 to 1.0 wt. % V, and 0.005 to 1.0 wt. % Ti.

40. The steel gear of claim 37, wherein said at least one element is selected from the group of 0.005 to 2 wt. % Al, 0.005 to 1.0 wt. % Ti, and 0.005 to 0.50 wt. % Zr.

41. The steel gear of claim 37, wherein said at least one element is selected from the group of 0.005 to 2 wt. % Al, 0.01 to 0.70 wt. % W, and 0.01 to 1.0 wt. % V.

42. The steel gear of claim 37, wherein said at least one element is 0.01 to 0.7 wt. % W.

43. The steel gear of claim 37, wherein said at least one element are 0.01 to 0.7 wt. % W and 0.01 to 1.0 wt. % V.

44. The steel gear of claim 37, wherein said at least one element is 0.01 to 1 wt. % V.

45. The steel gear of claim 37, wherein said at least one element is selected from the group of 0.01 to 1.0 wt. % V and 0.005 to 0.50 wt. % Zr.

46. The steel gear of claim 37, wherein said at least one element is 0.005 to 1 wt. % Ti.

47. The steel gear of claim 37, wherein said at least one element is selected from the group of 0.005 to 1 wt. % Ti and 0.005 to 0.5 wt. % Nb.

48. The steel gear of claim 37, wherein said at least one element is 0.005 to 0.5 wt. % Nb.

49. The steel gear of claim 37, wherein said at least one element is 0.005 to 0.5 wt. % Zr.

50. The steel gear of claim 37, wherein the $Ac_3$ point parameter ($Ac_3$) is from 870° to 930° C.

51. The steel gear of claim 37, wherein the ideal critical diameter ($D_I$) is from 30 to 150 mm.

52. The steel gear of claim 37, wherein the area percentage of ferrite is from 20 to 60%.

53. The steel gear of claim 37, wherein the steel gear has a distortion from 0 to 0.5 %.

54. A steel gear having been carburized and quenched said steel gear being formed from a steel composition consisting essentially of: 0.1 to 0.35 wt. % C, 0.01 to 2.5 wt. % Si, 0.01 to 2.5 wt. % Al, 0.5 to 2.6 wt. % Si+Al, 0.2 to 2.5 wt. % Mn, 0.01 to 2.5 wt. % Cr, and the balance being Fe and inevitable impurities;

said steel composition having an $Ac_3$ point parameter ($Ac_3$) of 850° to 960° C. and an ideal critical diameter ($D_1$) of 30 to 250 mm, the $Ac_3$ point parameter ($Ac_3$) and the ideal critical diameter ($D_I$) being defined by the following equations:

$$Ac_3=920-203\sqrt{C}+44.7\times Si-30\times Mn-11\times Cr+40\times Al$$

$$D_I=7.95\sqrt{C}(1+0.70\times Si)\ (1+3.3\times Mn)\ (1+2.16\times Cr)$$

, said steel gear having a non-carburized internal structure comprising martensite and 10 to 70 area % ferrite in a dual phase; and said steel gear having a distortion of a Navy C specimen of 1% or less.

55. The steel gear of claim 54, wherein the C content is from 0.15 to 0.25 wt. %.

56. The steel gear of claim 54, wherein the Si content is from 0.8 to 2.2 wt. %.

57. The steel gear of claim 54, wherein the Al content is from 0.02 to 2.45 wt. %.

58. The steel gear of claim 54, wherein the Mn content is from 0.5 to 2 wt. %.

59. The steel gear of claim 54, wherein the Cr content is from 0.2 to 2 wt. %.

60. The steel gear of claim 54, wherein the $Ac_3$ point parameter ($Ac_3$) is from 870° to 930° C.

61. The steel gear of claim 54, wherein the ideal critical diameter ($D_I$) is from 30 to 150 mm.

62. The steel gear of claim 54, wherein the area percentage of ferrite is from 20 to 60%.

63. The steel gear of claim 54, wherein the steel gear has a distortion from 0 to 0.5%.

64. A steel gear having been carburized and quenched, said steel gear formed from a steel composition consisting essentially of: 0.1 to 0.35 wt. % C, 0.01 to 2.5 wt. % Si, 0.01 to 2.5 wt. % Al, 0.5 to 2.6 wt. % Si +Al, 0.2 to 2.5 wt. % Mn, 0.01 to 2.5 wt. % Cr, and at least one element selected from the group of 0.01 to 0.7 wt. % Mo, 0.01 to 2 wt. % Ni, 0.01 to 0.7 wt. % W, 0.01 to 1 wt. % V, 0.005 to 1 wt. % Ti, 0.005 to 0.5 wt. % Nb, and 0.005 to 0.5 wt.% Zr, and the balance being Fe and inevitable impurities;

said steel composition having an $Ac_3$ point parameter ($Ac_3$) of 850° to 960° C. and an ideal critical diameter ($D_I$) of 30 to 250 mm, the $Ac_3$ point parameter ($Ac_3$) and the ideal critical diameter ($D_1$) being defined by the following equations:

$$Ac_3=920-203\sqrt{C}+44.7\times Si+31.5\times Mo-30\times Mn-11\times Cr+40\times Al-15.2\times Ni+13.1\times W+104\times V+40\times Ti$$

$$D_I=7.95\sqrt{C}(1+0.70\times Si)\ (1+3.3\times Mn)\ (1+2.16\times Cr)\ (1+3.0\times Mo)\ (1+0.36\times Ni)\ (1+5.0\times V)$$

said steel gear having a non-carburized internal structure comprising martensite and 10 to 70 area % ferrite in a dual phase; and said steel gear having a distortion of a Navy C specimen of 1% or less.

65. The steel gear of claim 64, wherein said at least one element is 0.01 to 0.7 wt. % Mo.

66. The steel gear of claim 64, wherein said at least one element is 0.01 to 2 wt. % Ni.

67. The steel gear of claim 64, wherein said at least one element is 0.01 to 0.7 wt. % W.

68. The steel gear of claim 64, wherein said at least one element is 0.01 to 1 wt. % V.

69. The steel gear of claim 64, wherein said at least one element is 0.005 to 1 wt. % Ti.

70. The steel gear of claim 64, wherein said at least one element is 0.005 to 0.5 wt. % Nb.

71. The steel gear of claim 64, wherein said at least one element is 0.005 to 0.5 wt. % Zr.

72. The steel gear of claim 64, wherein the $Ac_3$ point parameter ($Ac_3$) is from 870° to 930° C.

73. The steel gear of claim 64, wherein the ideal critical diameter ($D_I$) is from 30 to 150 mm.

74. The steel gear of claim 64, wherein the area percentage of ferrite is from 20 to 60%.

75. The steel gear of claim 64, wherein the steel gear has a distortion from 0 to 0.5% .

76. A method of producing a gear comprising:

forming a gear from a steel composition consisting essentially of: 0.1 to 0.35 wt. % C, 0.5 to 2.5 wt. % Si, 0.2 to 2.5 wt % Mn, 0.01 to 2.5 wt. % Cr. 0.01 to 0.7 wt. % Mo, and the balance being Fe and inevitable impurities;

said composition steel having an $Ac_3$ point parameter ($Ac_3$) of 850° to 960° C. and an ideal critical diameter ($D_1$) of 30 to 250 mm, the $Ac_3$ point parameter ($Ac_3$) and the ideal critical diameter ($D_I$) being defined by the following equations:

$$Ac_3=920-203\sqrt{C}+44.7\times Si+31.5\times Mo-30\times Mn-11\times Cr$$

$$D_I=7.95\sqrt{C}(1+0.70\times Si)\ (1+3.3\times Mn)\ (1+2.16\times Cr)\ (1+3.0\times Mo)$$

carburizing and quenching said gear, said gear having a non-carburized internal structure comprising martensite and 10 to 70 area % ferrite in a dual phase; said gear having a distortion of a Navy C specimen of 1% or less.

77. A steel composition consisting essentially of: 0.1 to 0.35 wt. % C, 0.5 to 2.5 wt. % Si, 0.2 to 2.5 wt. % Mn, 0.01 to 2.5 wt. % Cr, 0.01 to 0.7 wt. % Mo, 0.01 to 0.7 wt. % W and the balance being Fe and inevitable impurities:

said steel composition having an $Ac_3$ point parameter ($Ac_3$) of 850° to 960° C. and an ideal critical diameter ($D_I$) of 30 to 250 mm, the $Ac_3$ point parameter ($Ac_3$) and the ideal critical diameter ($D_I$) being defined by the following equations:

$$Ac_3=920-203\sqrt{C}+44.7\times Si+31.5\times Mo-30\times Mn-11\times Cr+13.1\times W$$

$$D_I=7.95\sqrt{C}(1+0.70\times Si)\ (1+3.3\times Mn)\ (1+2.16\times Cr)\ (1+3.0\times Mo)$$

said steel composition which when formed into a machine part and carburized and quenched having a non-carburized internal structure comprising martensite and 10 to 70 area % ferrite in a dual phase and having a distortion of a Navy C specimen of 1% or less.

* * * * *